US009010257B2

(12) United States Patent
McAlexander

(10) Patent No.: US 9,010,257 B2
(45) Date of Patent: Apr. 21, 2015

(54) LOCKING INSERT MECHANISM AND RECEIVER TO SECURE PERSONAL WEAPONS, VALUABLES AND OTHER ITEMS

(71) Applicant: Craig D. McAlexander, Plano, TX (US)

(72) Inventor: Craig D. McAlexander, Plano, TX (US)

( * ) Notice: Subject to any disclaimer, the term of this patent is extended or adjusted under 35 U.S.C. 154(b) by 0 days.

(21) Appl. No.: 13/786,303

(22) Filed: Mar. 5, 2013

(65) Prior Publication Data

US 2014/0083338 A1 Mar. 27, 2014

Related U.S. Application Data

(60) Provisional application No. 61/606,957, filed on Mar. 5, 2012.

(51) Int. Cl.

| | |
|---|---|
| ***E05G 1/00*** | (2006.01) |
| ***E05G 1/02*** | (2006.01) |
| *E05G 1/026* | (2006.01) |

(52) U.S. Cl.
CPC *E05G 1/02* (2013.01); *E05G 1/005* (2013.01); *E05G 1/026* (2013.01)

(58) Field of Classification Search
CPC ..... A47F 5/0018; E05G 1/005; E05G 1/02; E05G 1/026; G07G 1/0018
USPC ..... 70/63; 109/52, 58–59 R, 64, 74, 76, 82, 109/45, 47
See application file for complete search history.

(56) References Cited

U.S. PATENT DOCUMENTS

| | | | | |
|---|---|---|---|---|
| 4,193,353 | A * | 3/1980 | Hinton et al. | 109/50 |
| 5,235,920 | A * | 8/1993 | Hector | 109/51 |
| 5,607,102 | A * | 3/1997 | Walsh et al. | 232/1 D |
| 5,890,439 | A * | 4/1999 | McGunn | 109/47 |
| 6,431,203 | B1 * | 8/2002 | Zhu et al. | 137/315.01 |
| 7,434,427 | B1 * | 10/2008 | Miresmaili | 70/63 |
| 7,975,515 | B2 * | 7/2011 | Ygnelzi et al. | 70/168 |
| 8,186,188 | B1 * | 5/2012 | Brown | 70/63 |
| 8,590,714 | B1 * | 11/2013 | Osuna-Valerio | 211/4 |
| 2009/0015121 | A1 * | 1/2009 | Sampson | 312/242 |
| 2010/0043682 | A1 * | 2/2010 | Talmage et al. | 109/50 |
| 2013/0025511 | A1 * | 1/2013 | Maxwell | 109/59 R |
| 2014/0116303 | A1 * | 5/2014 | Mothersele | 109/64 |

* cited by examiner

*Primary Examiner* — Suzanne Barrett
(74) *Attorney, Agent, or Firm* — Howison & Arnott, LLP

(57) ABSTRACT

A personal security apparatus to house weapons, valuables, and/or items requiring concealment includes a lockable insert mechanism to securely house items and at least one receiving apparatus adapted to mount the insert mechanism into or onto various structures and a lockable access door that provides convenient, rapid access to the items contained in the personal security apparatus and further prevents access by unauthorized persons.

18 Claims, 29 Drawing Sheets

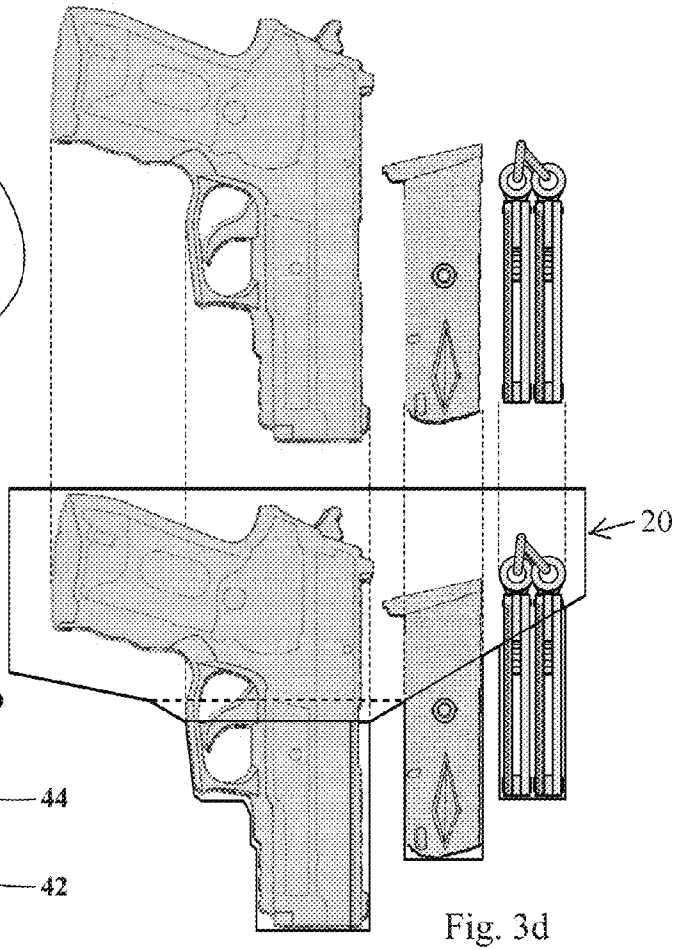
Fig. 3d
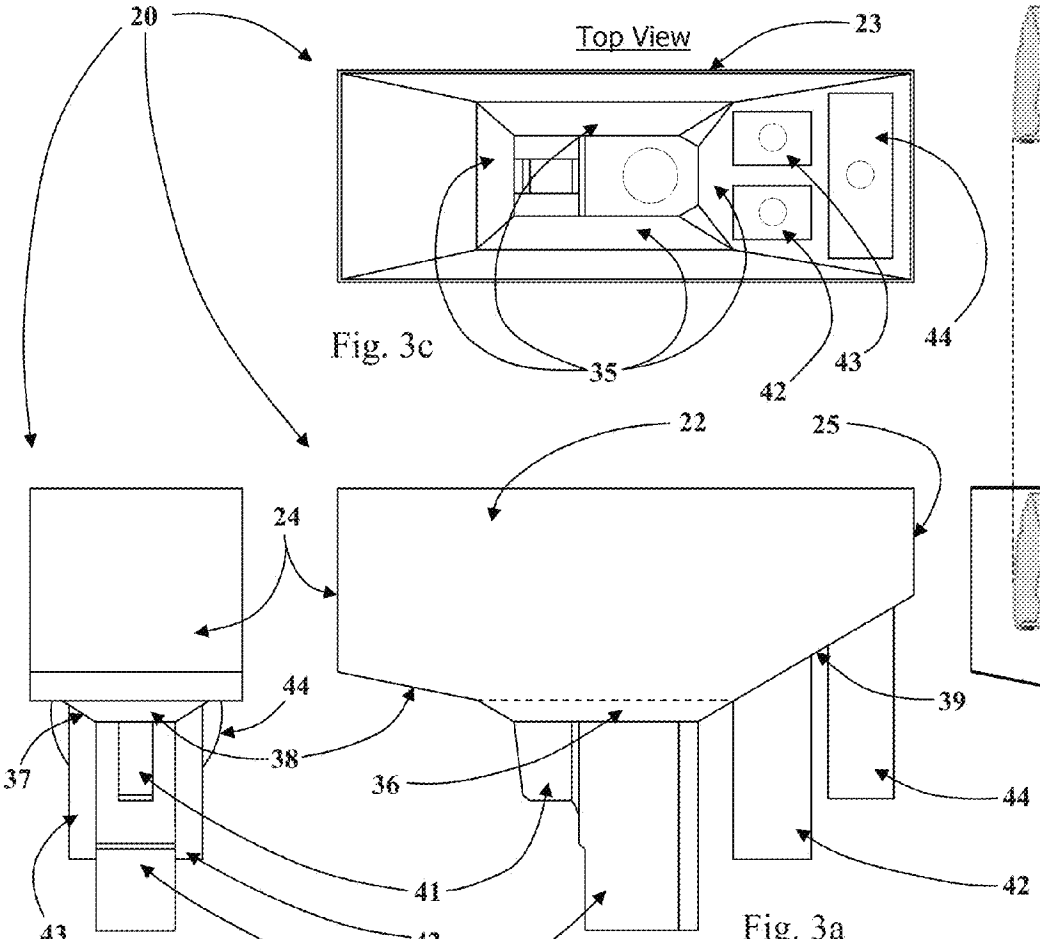

21

Side View
Door Open
20
26

Top View
27

Side View
Door Closed
26
21

Rear View
Door Closed
Rear View
Door Open

Rear View
Door Open

Rear View
Door Open

Rear View
Door Closed

Top View
Doors Open

Rear View
Doors Open

Side View
Doors Closed

Rear View
Doors Closed 20
62
65
64
66
61
50
Side View
Doors Closed 63
22
24a
24b
23
27
Rear View
Doors Open Rear View
Doors Closed 160
110
96
90
162
161
Rear View (Bag Lifted Up; Mounting Apparatus Extended)

160
110
96
90
Rear View (Bag Sitting at Rest; Mounting Apparatus Compressed)

50
56
95
94
93
115
110
112
94
95
114
116
117
118
119
113
111
93

Side View
(Open)

Side View
(Closed / Locked)

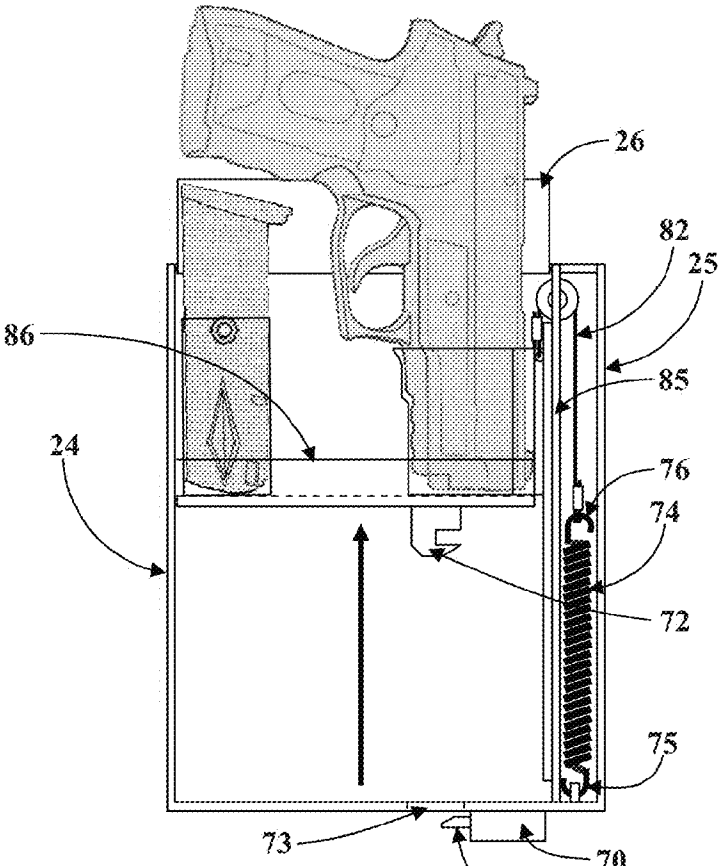
Side View (Open) Fig 14b
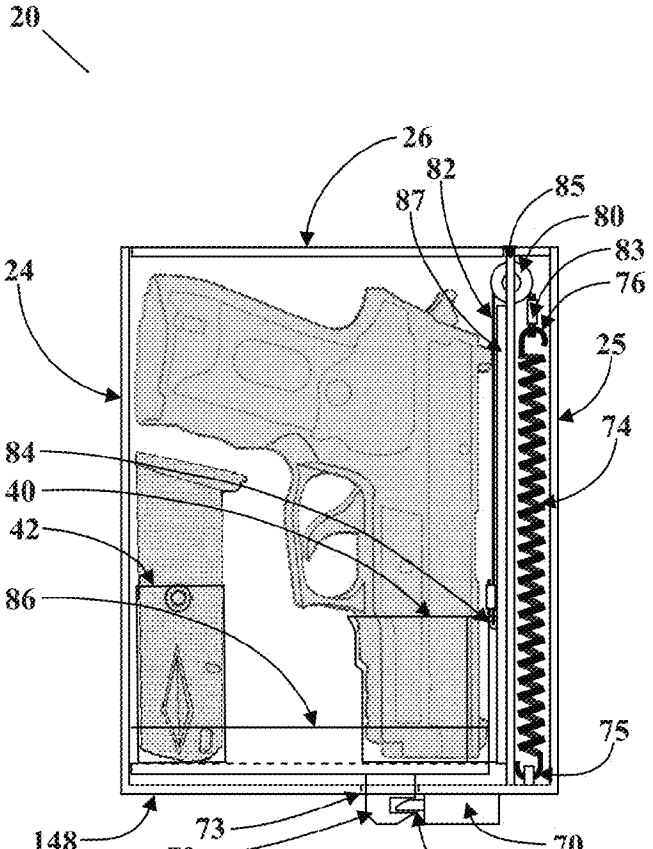
Side View (Closed / Locked) Fig 14a 20
24
82
40
42
81
148
89
26
84
73
72
71
70
75
74
76
83
80
85

Side View
(Closed / Locked)
89
27
22

Side View
(Closed / Locked)
24
72
22
26
73
71
70
74

Side View
(Open)

155
157
12:00 PM
156
20
50

152
153
50
150
151
20

50
20

50
20

20
160
161
162

50
20

20
50

20
50

20
50

20
50

26
120
123
170
Top View
Door Closed
Portion of Insert Mechanism in Retracted Position Retractable
20
120
56
170
Side View
(Door Closed & Retractable Portion of
Insert Mechanism in Retracted Position)

20
50
Side View
(Door Open & Retractable Portion of
Insert Mechanism in Extended Position)

LOCKING INSERT MECHANISM AND RECEIVER TO SECURE PERSONAL WEAPONS, VALUABLES AND OTHER ITEMS

CROSS-REFERENCE TO RELATED APPLICATIONS

This application claims benefit of U.S. Provisional Application No. 61/606,957, filed Mar. 5, 2012, entitled LOCKING INSERT MECHANISM AND RECEIVER TO SECURE PERSONAL WEAPONS, VALUABLES AND OTHER ITEMS, the specification of which is incorporated herein in its entirety.

TECHNICAL FIELD

The disclosure relates to an apparatus for having a weapon (s), valuables, jewelry or other item(s) that may be concealed in a compact, portable encasement.

BACKGROUND

Devices designed for storage and to be utilized as a theft deterrent for items such as a weapon, valuables, jewelry, and other items include safes, locking cabinets, locking drawers, and hidden compartments. Weapons that may require additional safety precautions such as firearms and knives also require concealed and safe storage for theft prevention to protect children and unauthorized persons from acquiring access to these potentially harmful items.

Safes, strong boxes, drawers, and closets fitted with various chains and locks have been in existence for many centuries. These enclosures are heavy, bulky and, at the least, impractical to remain in accessible proximity to a person during normal daily activities.

More recently, firearm trigger guard locks have been used as a protective apparatus to aid in the prevention of injury of children and of persons not trained in firearm safety. However, firearm trigger guards do not conceal a weapon from the sight of a child, thief, or unapproved person and do not allow rapid access to a firearm during a crisis situation such as the domestic break-in by an assailant.

Bedside gun safes are commercially available but these devices are often too large and cumbersome for a person to carry. Further, these units are not easily and securely mounted in a concealable fashion in the various environments that a person goes throughout their day.

Due to the increase in criminal activities in recent years, many states have passed laws that permit licensed civilians to carry handguns in a concealed manner (Concealed Handgun License—CHL). A number of factors should be considered in connection with concealed weapons. A weapon such as a firearm should be conveniently concealed in each of a multiple of environments and social settings. Rapid access to the firearm or other weapon when desired or during a crisis situation is, of course, important. Children and unauthorized persons must also be prevented from accessing the firearm or weapon.

The present invention addresses and provides a solution to these needs.

SUMMARY

Accordingly, it is an object of the present invention to provide a locking insert mechanism and a mating receiver that allows a user to secure items such as cash, credit cards, personal identification documents, jewelry, weapons, ammunition, spray irritant and/or spray immobilizers, prescription medication, keys, etc. within a portable enclosure portion of the locking insert mechanism and prevent access to the items contained within the enclosure by children and other unauthorized persons.

One embodiment provides one or more doors fixed to a locking insert mechanism such that access to item(s) housed within the portable enclosure portion is enabled only when the doors are open. The door(s) of the portable enclosure are normally locked in a closed position and open via a locking device such as a key, keypad, biometric sensor, RFID device, or wireless transmitter/transceiver. The locking insert mechanism fastens to a mating receiver in such a way that the two portions lock together. One embodiment provides a second locking device that prevents the locking insert mechanism and mating receiver from separating unless the locking device has been disabled/unlocked. The second locking device may be an independent structure from the first locking device or it can be incorporated into the structure of the first locking device. For example, a single key lock can be utilized in such a way that inserting and rotating the key in a clockwise direction causes the access door(s) to open and rotating the key in a counter-clockwise direction releases the locking insert mechanism from the mating receiver. Another variation uses a keypad in such that actuating a plurality of buttons in a first sequence causes the access door(s) to open and actuating a plurality of buttons in a second sequence releases the locking insert mechanism from the mating receiver. In one aspect, a locking device includes a combination of technologies. For example, a biometric fingerprint reader can be used in combination with mechanical buttons, switches or soft keys. Placing the user's middle finger on the biometric fingerprint reader and depressing a button located on a first side of the biometric fingerprint reader causes the access door(s) to open. Placing the user's middle finger on the biometric fingerprint reader and depressing a button located on a second side of the biometric fingerprint reader releases the locking insert mechanism from the mating receiver. Different types of locking devices presently available or various locking devices that may be available in the future, may be utilized in place of, or in combination with, locking devices described herein.

The mating receiver is adapted to be physically compatible with at least one mounting structure. In one variation, a plurality of flexible stays are adjustably fastened to the mating receiver and further fastened to but not limited to the inside wall(s) of a hand bag, purse, pouch, or knapsack.

Another embodiment provides holes in at least one side of the mating receiver that such the mating receiver may be fastened to a separate structure via screws, rivets, or other fasteners. For example, the mating receiver can be fastened to a wall of a desk, recessed into a desktop surface, or mounted inside a desk drawer.

In another aspect, a personal security network includes a plurality of mating receivers each mounted to one of a variety of structures. For example, a first mating receiver can be mounted inside a handbag; with a second mating receiver mounted inside a brief case. A third mating receiver may be mounted in the center console or glove compartment of a motor vehicle. A forth mating receiver may be mounted to a wall of a desk or inside the drawer of a desk. A fifth mating receiver may be mounted to a night stand or bed frame. A sixth mating receiver can be mounted inside a kitchen or bathroom cabinet. A seventh mating receiver may be mounted into a recessed cavity behind a picture or mirror on the wall of a home or office. A personal security network comprising a plurality of mating receivers allows a user to quickly fasten the locking insert mechanism into the mating receiver that is in closest proximity to their person as the user moves from location to location throughout the user's daily routine. Such a personal security network provides an approved user convenient and immediate access to the contents of the portable enclosure portion of the locking insert mechanism regardless of where the user is located.

BRIEF DESCRIPTION OF THE DRAWINGS

For a more complete understanding, reference is now made to the following description taken in conjunction with the accompanying Drawings in which:

FIGS. 3*a*-3*c* are partial side, rear and top views of a locking insert mechanism of FIGS. 2*a* and 2*b* wherein the locking access doors are omitted for clarity;

FIG. 3*d* illustrates insertion of a weapon into the locking insert mechanism of FIGS. 3*a*-3*c;*

FIGS. 14*a*-14*b* illustrate an embodiment of the locking insert mechanism adapted to receive a hand gun or similar item at an inclination parallel to the side walls of the locking insert;

DETAILED DESCRIPTION

Figure 1:
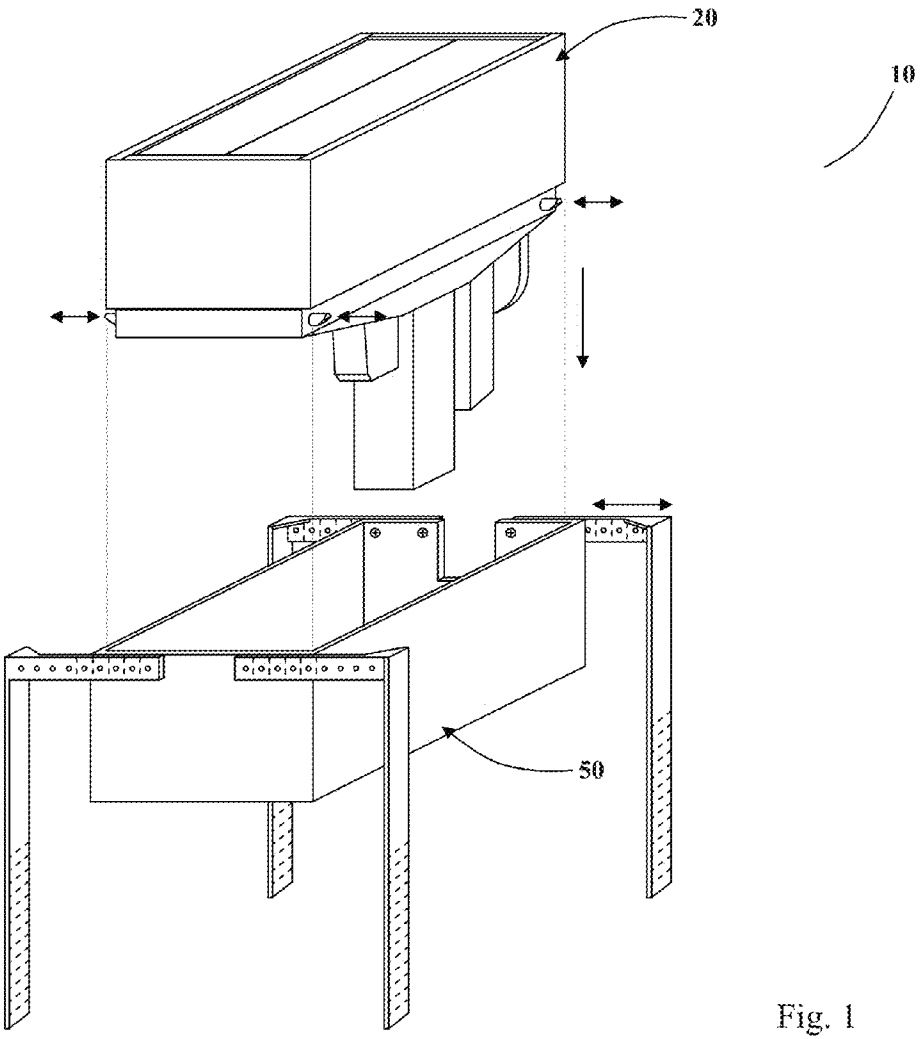
FIG. 1 is a perspective view of a locking insert and receiver according to the disclosure.

Referring now to the drawings, wherein like reference numbers are used herein to designate like elements throughout, the various views and embodiments of a locking insert mechanism and receiver to secure personal weapons, valuables and other items are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

In the following detailed description, reference is made to the accompanying drawings that form a part hereof, and in which are shown by way of illustration specific embodiments in which the invention may be practiced. It is understood that other embodiments may be utilized and structural changes may be made without departing from the scope of the invention.

FIG. 1 is a perspective view of a personal security apparatus 10 including a locking insert mechanism 20 and a receiver adapted to receive the locking insert. Locking insert 20 and receiver 50 are configured with dimensional tolerances sufficient to allow at least a portion of locking insert 20 to fit within or to be affixed to the structure of receiver 50. Locking insert 20 and receiver 50 formed from a suitable material such as, but not limited to, structural plastic, reinforced thermoplastic, acrylic, glass filled nylon, fiberglass, abs, structural foam, carbon fiber, other polymer material, aluminum, steel, or other metal, etc. or a combination of materials.

Figure 2A:
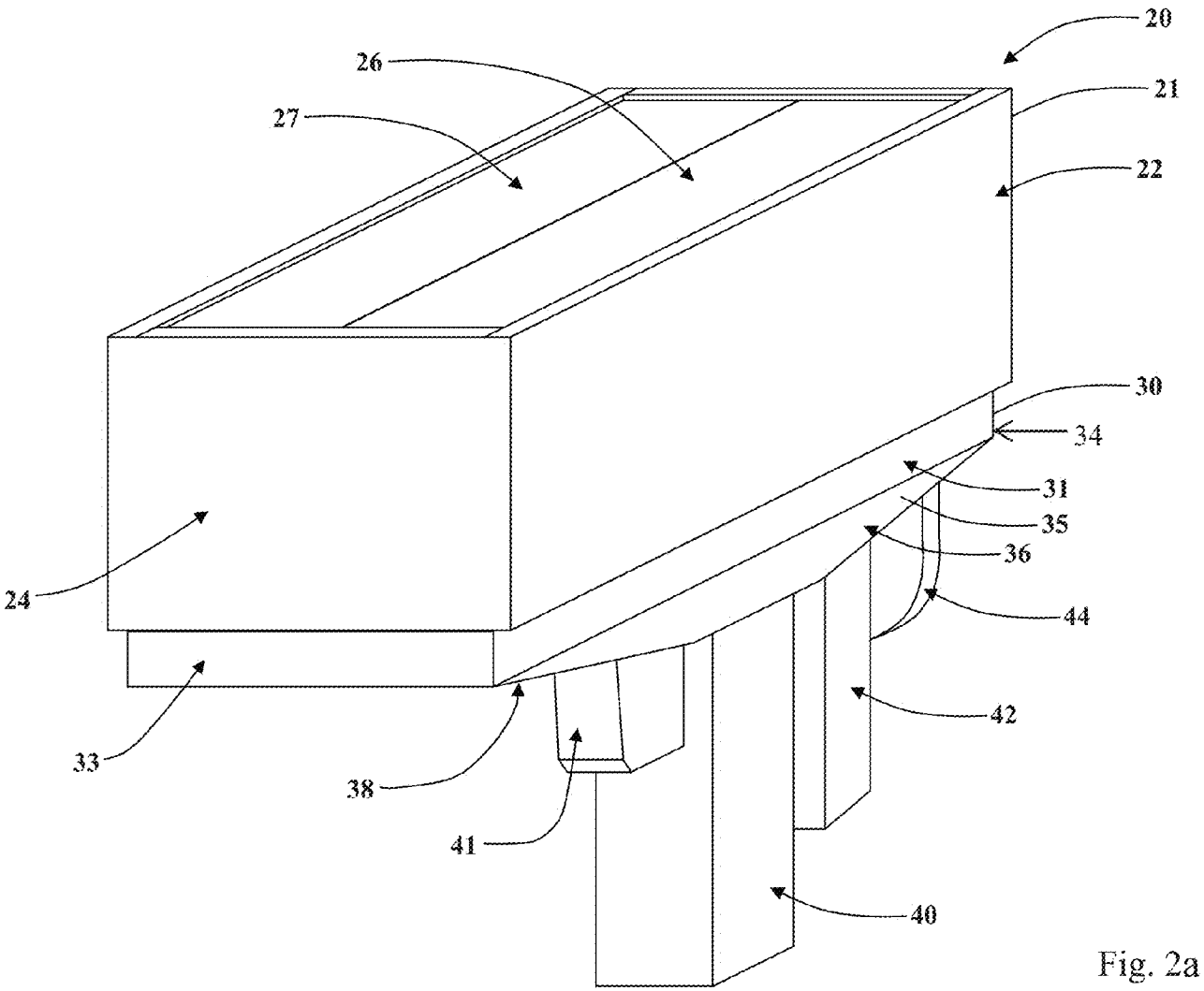
FIG. 2*a* is a perspective view of the locking insert mechanism of FIG. 1.

FIG. 2*a* is a perspective view of insert 20 portion of FIG. 1. Insert 20 is includes an upper encasement 21 and a lower encasement 30. Upper encasement 20 includes parallel opposed side walls 22 and 23 and parallel opposed end walls 24 and 25. A first access door 26 and a second access door 27 are attached to opposing walls 24 and 25 of insert mechanism 20 in such a way that doors 26 and 27 open and close as described hereinafter. Upper encasement 21 and/or lower encasement 30 of insert mechanism 20 may be configured with geometries other than a symmetrical rectangular geometric shape or structure. For example, lower encasement 30 and insert mechanism 20 may be configured as symmetrical or asymmetrical circular, oval or spherical structures.

Lower encasement 30 includes opposed side walls 31 and 32 and opposed end walls 33 and 34. Opposed side walls 31 and 32 and opposed end walls 33 and 34 of lower encasement 30 are perpendicular to, and configured in such a way as to mate with opposed parallel side walls 22 and 23 and opposed parallel end walls 24 and 25 of upper encasement 21, respectively. Lower encasement 30 includes a hopper section 35 with ramp surfaces 36, 27, 28 and 39 (FIG. 3*a*) and at least one encasement portion 40-44 extending downwardly from hopper section 35. A plurality of different lower encasement 30 structures can be implemented to house various items of different shapes and sizes adapted to fit a common size upper encasement 21. A plurality of different encasement portions 40-44 can be shaped to house various items of different shapes and sizes and adapted to fit a common size lower encasement 30. In one embodiment, lower encasement 30 does not include hopper section 35, comprising ramp surfaces 36-39, or encasement portions 40-44. In this embodiment, lower encasement 30 forms a rectangular storage portion which is formed by increasing the height of opposing walls 31 and 32 and opposing walls 33 and 34 and fixing these opposing walls to a flat bottom wall.

Figures 2B, 2C:
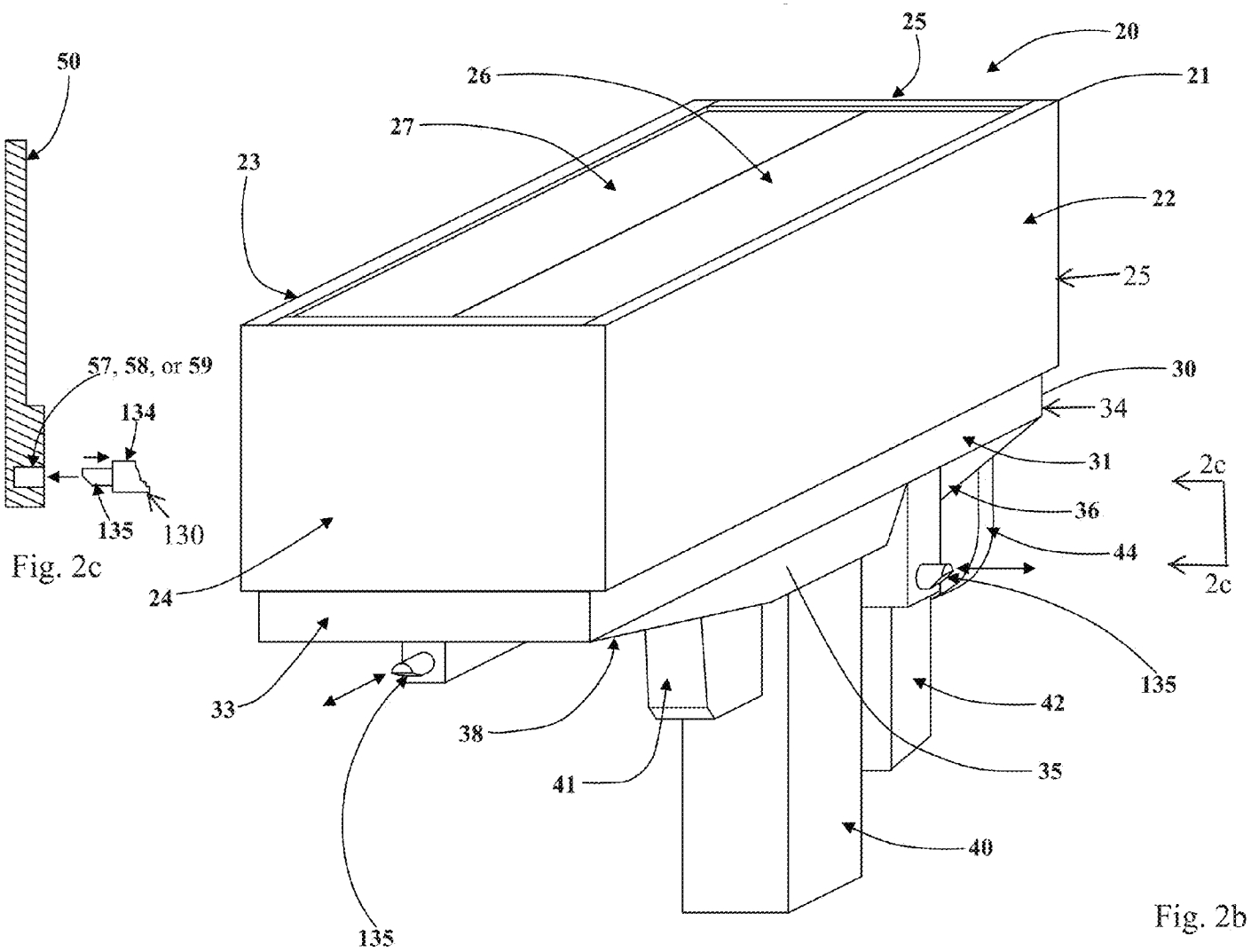
FIG. 2*b* is a partial perspective view of the locking insert mechanism of FIG. 2*a* illustrating one embodiment of a dock locking mechanism.
FIG. 2*c* is a cross-section of one wall of the receiver of FIG. 2*b* taken along line 2*c*-2*c;*

FIG. 2*b* is a perspective view of the locking insert of FIG. 2*a* illustrating dock lock 130 and actuators 135. FIG. 2*c* is a cross-section of a wall section of receiver 50 partially illustrating a dock lock 130 including actuator housing 134 and actuator(s) 135. As illustrated, actuator 135 is configured to extend into a detent 57, a non-circular counter-bore detent 58 or a polygonal shaped counter-bore detent 59 when locking insert 20 is inserted into receiver 50.

Figures 2D, 2E:
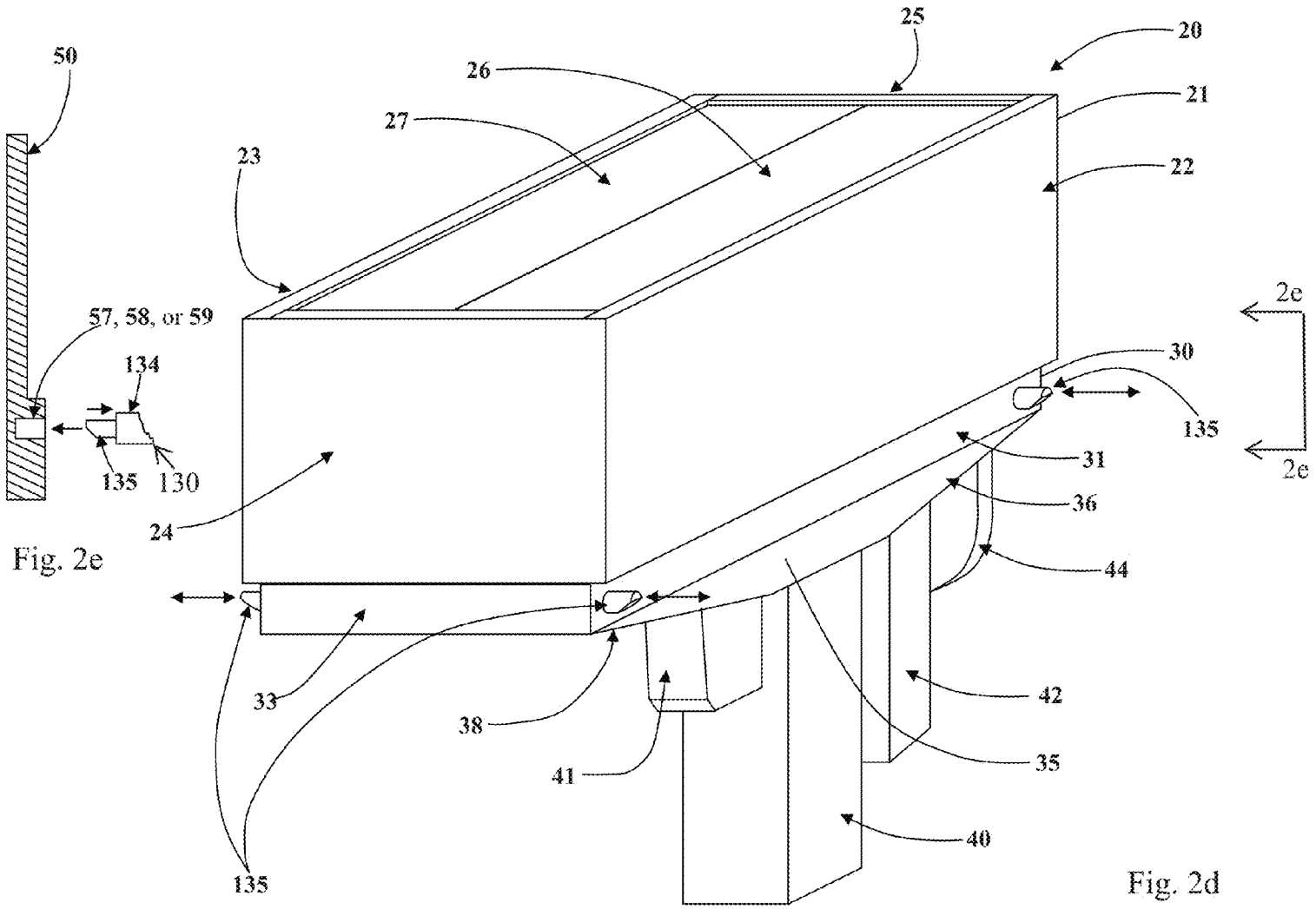
FIG. 2*d* is a partial perspective view of the locking insert mechanism of FIG. 2*a* illustrating another embodiment of the dock locking mechanism.
FIG. 2*e* is a cross-section of one wall of the receiver of FIG. 2*d* taken along line 2*e*-2*e;*

FIG. 2*d* is a perspective view of insert 20 illustrating an alternative placement of dock locks 130 on locking insert 20. FIG. 2*e* is a cross-section of a wall section 31 of receiver 50 partially, illustrating the structure of a portion of dock lock 130 including actuator housing 134 and actuator(s) 135. Actuator 135 is configured to extend into a detent 57, a non-circular counter-bore detent 58 or a polygonal shaped counter-bore detent 59 when locking insert 20 is inserted into receiver 50.

FIGS. 3*a*, 3*b* and/or 3*c* are side, rear, and top views of the locking insert of FIG. 2*b* with access doors 26 and 27 omitted for clarity. FIG. 3*d* is a partial side view of the insert of 2*b* with the side panel(s) of the insert mechanism 20 omitted for clarity. As illustrated, insert mechanism 20 may receive and enclose a hand gun in encasement portion 40, two ammunition magazines in encasement portions 42 and 43 and a pair of handcuffs in encasement portion 44. As illustrated, each of encasement portions 40-44 extend downwardly from angled ramp surfaces 36-39 of hopper section 35. Hopper section 35 includes ramped surfaces 36-39 to assist in guiding the firearm into the stored position when the hand gun is inserted into insert mechanism 20. Ramp surfaces 36-39 of hopper section 35 are downwardly angled from walls 22-25 to the upper ends of encasement portions 40-44 and serve to guide a hand gun and magazines into the encasement portions of insert mechanism 20. As illustrated, encasement portions 40-44 are generally rectangular, downwardly extending structures, however, other geometries such as circular or oval may be used in different applications, depending upon the item(s) to be received in the encasement portions.

Figures 4A, 4B, 4C, 4D, 4E:
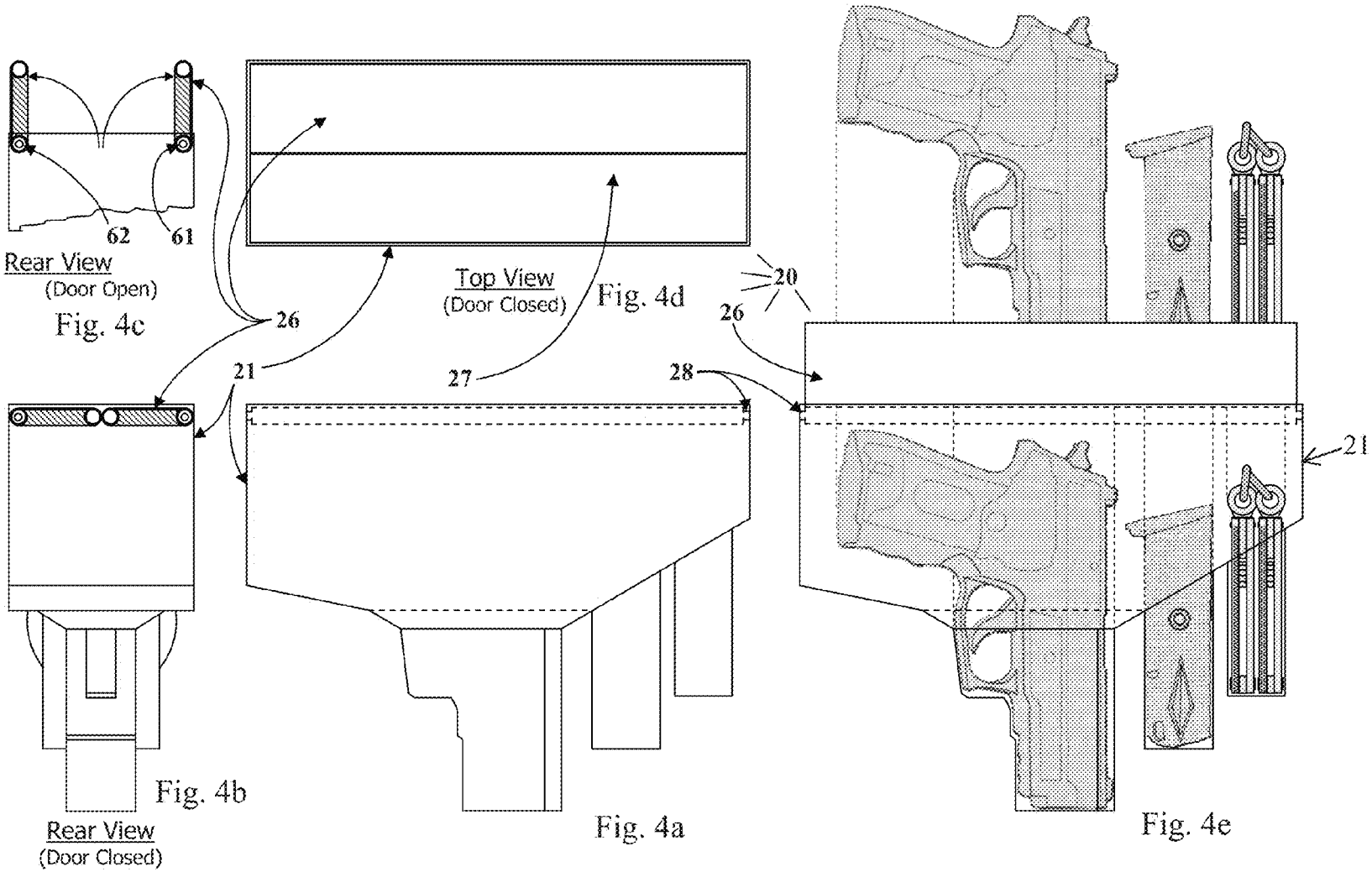
FIGS. 4*a*-4*d* are partial side, rear and top views of the locking insert mechanism of FIG. 2*b* further illustrating the locking access doors.
FIG. 4*e* illustrates insertion of a weapon into the locking insert mechanism of FIGS. 4*a*-4*d;*
Figures 5A, 5B, 5C, 5D, 5E:
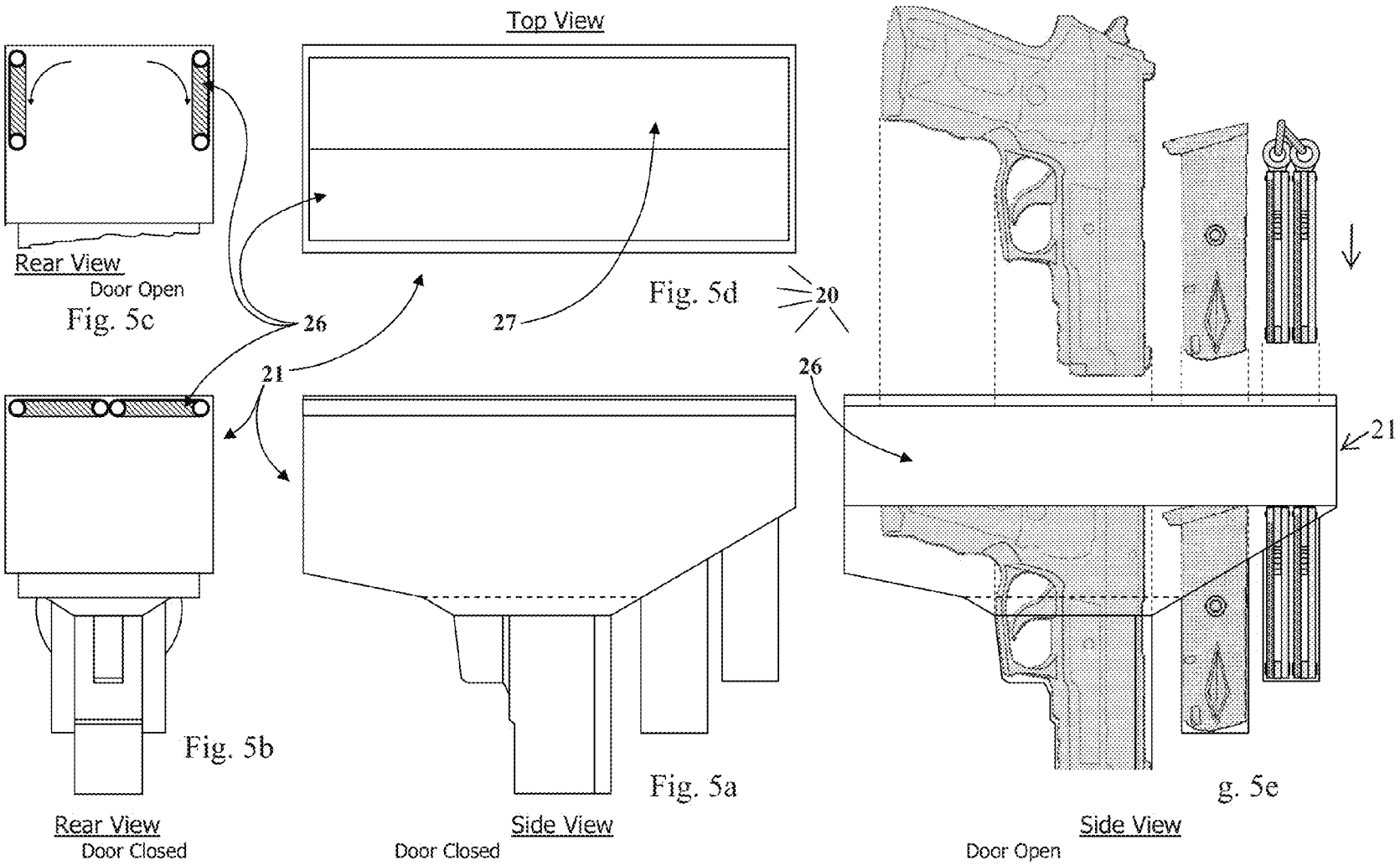
FIGS. 5*a*-5*d* are partial side, rear and top views of the locking insert mechanism illustrating a second embodiment of the locking access doors.
FIG. 5*e* illustrates insertion of a weapon, extra magazines, and handcuffs into the locking mechanism of FIGS. 5*a*-5*d;*

Referring again to FIG. 2*a* and FIG. 3*c*, locking insert 20 is illustrated with access doors 26 and 27 in open and closed positions, respectively. FIGS. 4*a*, 4*b*, 4*c* and 4*d* are partial side, rear and top views of the locking insert of FIG. 2*b* further illustrating the access doors of the insert. Access doors 26 and 27 pivot on axle rods 60 and 61 which extend out beyond access doors 26 and 27 and into the upper encasement 21 of locking insert mechanism 20. As best illustrated in FIG. 4*c*, access doors 26 and 27 are configured to swing upwardly and outwardly away from parallel opposed sidewalls 22 and 23 of upper encasement 21.

In various embodiments, access doors 26 and 27 may be actuated by one or a combination of mechanically assisted, electro-mechanical, pneumatic, hydraulic, and/or totally manual operated structures. One structure and method can be employed to open access doors 26 and 27 and the same or different structure and method can be employed to close access doors 26 and 27. Although as illustrated, two access doors 26 and 27 are utilized, a structure comprising a single access door or more than two access doors may be implemented. For example, a single door similar to the combined surface area of access doors 26 and 27 can be used. The single door may be configured to retract into upper encasement 21 parallel and adjacent to wall 22 (or to wall 23) of upper encasement 21. Another embodiment of the present invention uses a hinging door structure that pivots from one edge of the door so that a portion of a single door extends outward and beyond upper encasement 21. FIG. 4*e* illustrates insertion of a hand gun and magazines into insert 20 through doors 26 and 27.

In one alternative embodiment, spring-loaded hinges may be utilized as an alternative structure to axle rods 60 and 61. In this alternative, releasing the door locking mechanism 70 (FIG. 13*a*) permits rotational loading of the spring-loaded hinges to open access doors 26 and 27. Closing access doors 26 and 27 is achieved by applying sufficient force, opposite to the opening direction, to overcome the loading of the spring-loaded hinges.

FIGS. 5*a*, 5*b*, 5*c* and 5*d* are partial side, rear, and top views of second embodiment of a locking insert mechanism 20 illustrating an alternative structure to open and close access doors 26 and 27. In the embodiment illustrated in 5*a*, 5*b*, 5*c* and 5*d*, doors 26 and 27 access doors 26 and 27 retract into the upper encasement 21 portion of locking insert mechanism 20. FIG. 5*e* illustrates insertion of a hand gun and magazines into the insert mechanism of FIGS. 5*a*-5*d*.

Figures 6A, 6B, 6C:
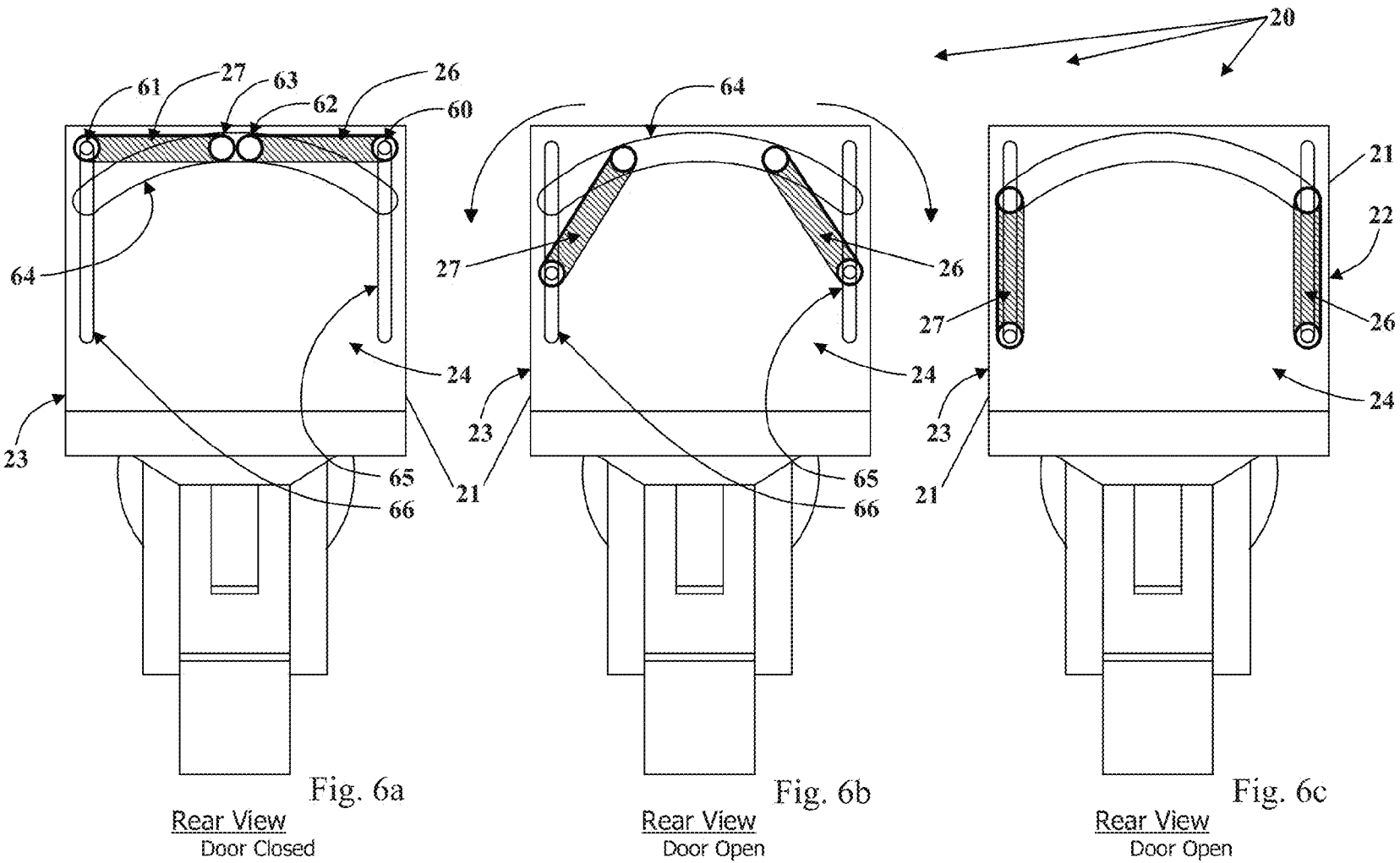
FIGS. 6*a*-6*c* are partial rear views of the locking insert mechanism of FIGS. 5*a*-5*d* of the present invention illustrating the operation of the locking access doors.

FIGS. 6*a*, 6*b*, and 6*c* are partial rear views of the locking insert mechanism of FIGS. 5*a*-5*d* with portion omitted to illustrate in greater detail the operation of the locking insert. FIG. 6*a* illustrates access doors 26 and 27 in the closed position and FIG. 6*b* shows access doors 26 and 27 in the half-open position. FIG. 6*c* is a rear view of locking insert 20 that shows access doors 26 and 27 in the open position. As illustrated, access doors 26 and 27 each have a first axle rod 60 and 61, respectively and a second axle rod 62 and 63. Axle rods 60, 61, 62, and 63 extend out beyond the ends of access doors 26 and 27 that are adjacent to end walls 24 and 25 (FIG. 2*b*) of upper encasement 21. First axle rods 60 and 61 have a smaller diameter than second axle rods 62 and 63 and extend beyond the ends of access doors 26 and 27 a greater distance than second axle rods 62 and 63. End walls 24 and 25 of upper encasement 21 of locking insert mechanism 20 each have a plurality of counter-bored groves 64, 65, and 66 that receive the ends of axle rods 60-63. Counter-bores grooves 64, 65 and 66 are located on the inside surface of opposed end walls 24 and 25. Counter-bored groove 64 is an arced groove having an inner radius r and an outer radius r+W.

Therefore, the width of arched counter-bored groove 64 is:

$$(r+W)-r=W$$

The counter-bored grooves 65 and 66 of end walls 24 and 25 are vertical, parallel, and opposed to each other as shown in FIGS. 6*a*-*c*. The depth of counter-bored grooves 65 and 66 is greater than the depth of counter-bored groove 64. The width (w) of counter-bored grooves 65 and 66 is less than the width of arched counter-bored groove 64 (w).

The depth and width of arched counter-bored grooves 64 in walls 24 and 25 is sufficient to provide adequate tolerance so as to allow the ends of axle rods 62 and 63 to slide along the arched path of counter-bored groove 64 between and perpendicular to end walls 24 and 25 with minimal friction. The length of axle rods 62 and 63 is selected to permit the ends of the side rods to be received in and slide along groove 64. The depth and width of vertical counter-bored grooves 65 and 66 in walls 24 and 25 is selected to provide sufficient tolerance to allow the ends of axle rods 60 and 61 to slide along the vertical path of counter-bored grooves 65 and 66, between and perpendicular to walls 24 and 25, with minimal friction. The length of axle rods 60 and 61 is selected to enable the ends of axle rods 60 and 61 to be received in and move freely along grooves 65 and 66, respectively. The embodiment of locking insert 20 illustrated in FIGS. 6*a*-6*c* allows access doors 26 and 27 to retract into upper encasement 21 parallel and adjacent to side walls 22 and 23, respectively. When access doors 26 and 27 open, the doors move in a lateral, opposing direction and retract into the structure of upper encasement 21 of locking insert mechanism 20. In the illustrated embodiment, the access doors 26 and 27 do not extend above the structure of locking insert mechanism 20 and thus avoid contact with a user's hand at a time when the user chooses to open lockable insert mechanism 20 and/or remove the item(s) contained therein. Access doors 26 and 27 can be actuated to open and close the doors with one or a combination of mechanically assisted, electro-mechanical, pneumatic, hydraulic, and/or totally manual actuated mechanisms and structures. A first structure and method can be employed to open access doors 26 and 27 and the same or different structure and method can be employed to close access doors 26 and 27. Although the embodiment disclosed in FIGS. 5*a*-5*d* and 6*a*-6*c* utilizes two access doors 26 and 27, one access door or more than two access doors can be utilized. For example, a single door retracts into upper encasement 21, parallel and adjacent to wall 22 (or wall 23) of upper encasement 21 may be utilized.

Figures 7A, 7B, 7C, 7D, 7E:
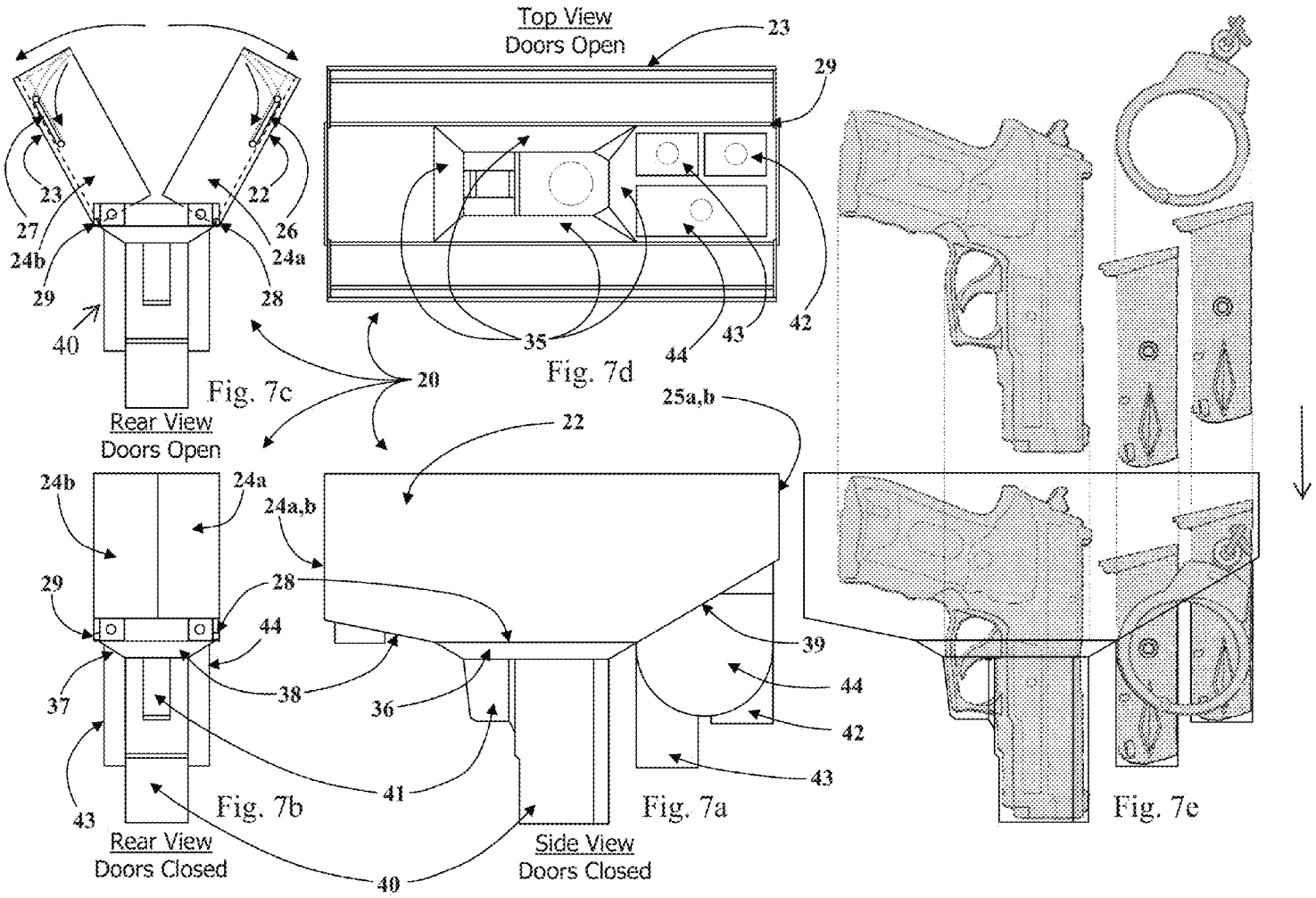
FIGS. 7*a*-7*d* are partial side, rear and top views of another embodiment of a locking insert mechanism.
FIG. 7*e* illustrates insertion of a weapon, extra magazines, and handcuffs into the locking insert mechanism of FIGS. 7*a*-7*d;*

FIGS. 7*a*, 7*b*, 7*c* and 7*d* are side, rear, and top views illustrating a fourth embodiment of the locking insert 20 with the side panel. FIG. 7*e* illustrates insert mechanism 20 housing a hand gun, two ammunition magazines, and a pair of handcuffs. The embodiment illustrated in FIGS. 7*a*-7*d* facilitates user access to the contents housed within locking insert mechanism 20. Ramp surfaces 36-39 of hopper section 35 assist in guiding the firearm into the stored position when the hand gun is inserted into insert mechanism 20. Specifically, ramp surfaces 36-39 of hopper section 35 guides the hand gun into encasement portions 40 and 41. The embodiment illustrated in the FIGS. 7*a*, 7*b*, 7*c* and 7*d* illustrates a structure that allows a user to gain access to the contents housed within locking insert mechanism 20 whereby the user may directly grasp the item when walls 22 and 23 (and wall sections 24*a*, 24*b* and 25*a*, 25*b*) are swung outwardly as shown in FIG. 7*c*. As illustrated, walls 24 and 25 of FIG. 6 are vertically sectioned in half into sections 24*a*, 24*b* and 25*a*, 25*b* with the outside vertical edge of wall sections 24*a* and 25*a* affixed to the adjacent vertical edges of wall 22.

A first "c-channel" is thereby formed by joining the adjacent, vertical edges of wall section 24*a* to wall 22 and the adjacent, vertical edge of wall 22 to wall section 25*a*. Similarly, the outside vertical edge of wall sections 24*b* and 25*b* are affixed to the adjacent vertical edge of wall 23. A second "c-channel" is thereby formed by joining the adjacent, vertical edge of wall section 24*b* to wall 23 and the adjacent, vertical edges of wall 23 to wall section 25*b*. As illustrated, access doors 26 and 27 are retractable inside the upper encasement 21 portion of locking insert mechanism 20 as described in connection with FIG. 6*a*-6*c*. Walls 22 and 23 (and wall sections 24*a*, 24*b* and 25*a*, 25*b*) of upper encasement 21 are configured to swing outwardly as illustrated. The lower edges of walls 22 and 23 adjacent to ramp surfaces 36 and 37, respectively, are coupled by hinges 28 and 29, respectively to the upper end of lower easement 40. The outward swinging functionality permits, the combined width of wall sections 24*a*, 24*b* to be significantly narrower than wall 24 of FIGS. 6*a*-6*c*. Likewise, the combined width of wall sections 25*a*, 25*b* can be significantly narrower than wall 24 of the embodiment of FIGS. 6*a*-6*c*. This permits walls 22 and 23 to be physically closer to each other when locking insert mechanism 20 is closed. If the unit is to be used to house a handgun, a user must grip the handle of the handgun with his hand before removing the firearm. The additional thickness of the user's hand requires additional room inside insert mechanism 20. The outwardly swinging structure of wall section 24*a*, 24*b* eliminates a need for additional room to accommodate the user's hand inside insert mechanism 20.

Thus, the over-all external size of the insert mechanism 20 of FIGS. 7*a*-7*e*, when closed, can be significantly narrower than the preceding embodiments. Access doors 26 and 27 and walls 22 and 23 may be actuated by a combination of mechanically assisted, electro-mechanical, pneumatic, hydraulic, and/or totally manual operated actuators and structures. A first structure and method can be employed to open access doors 26 and 27 and/or walls 22 and 23 and the same or different structure and method can be employed to close access doors 26 and 27 and/or walls 22 and 23. Although the embodiment illustrated in FIGS. 7*a*-7*c* has two access doors, and two outwardly swinging walls, an embodiment comprising only one access door and/or one outwardly swinging wall or more than two access doors and/or outwardly swinging walls may be implemented. For example, a single door similar to the combined surface area of access doors 26 and 27 can be used with one outwardly swinging wall. In this embodiment, the single door retracts into upper encasement 21, parallel and adjacent to wall 22 (or wall 23) of upper encasement 21.

Figure 8:
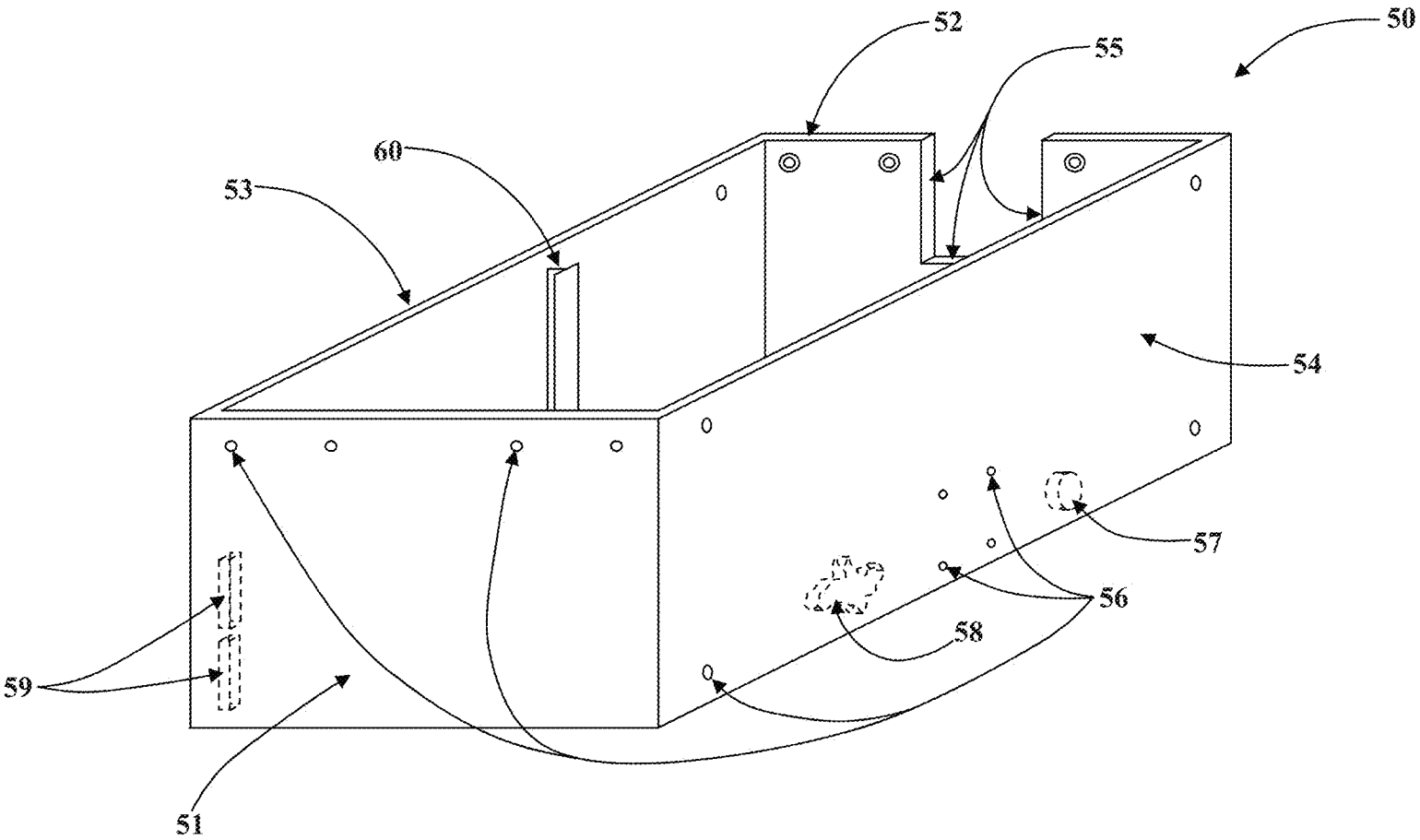
FIG. 8 is a partial perspective view of one embodiment of a mating receiver of the disclosure.
Figures 9A, 9B, 9C, 9D, 9E:
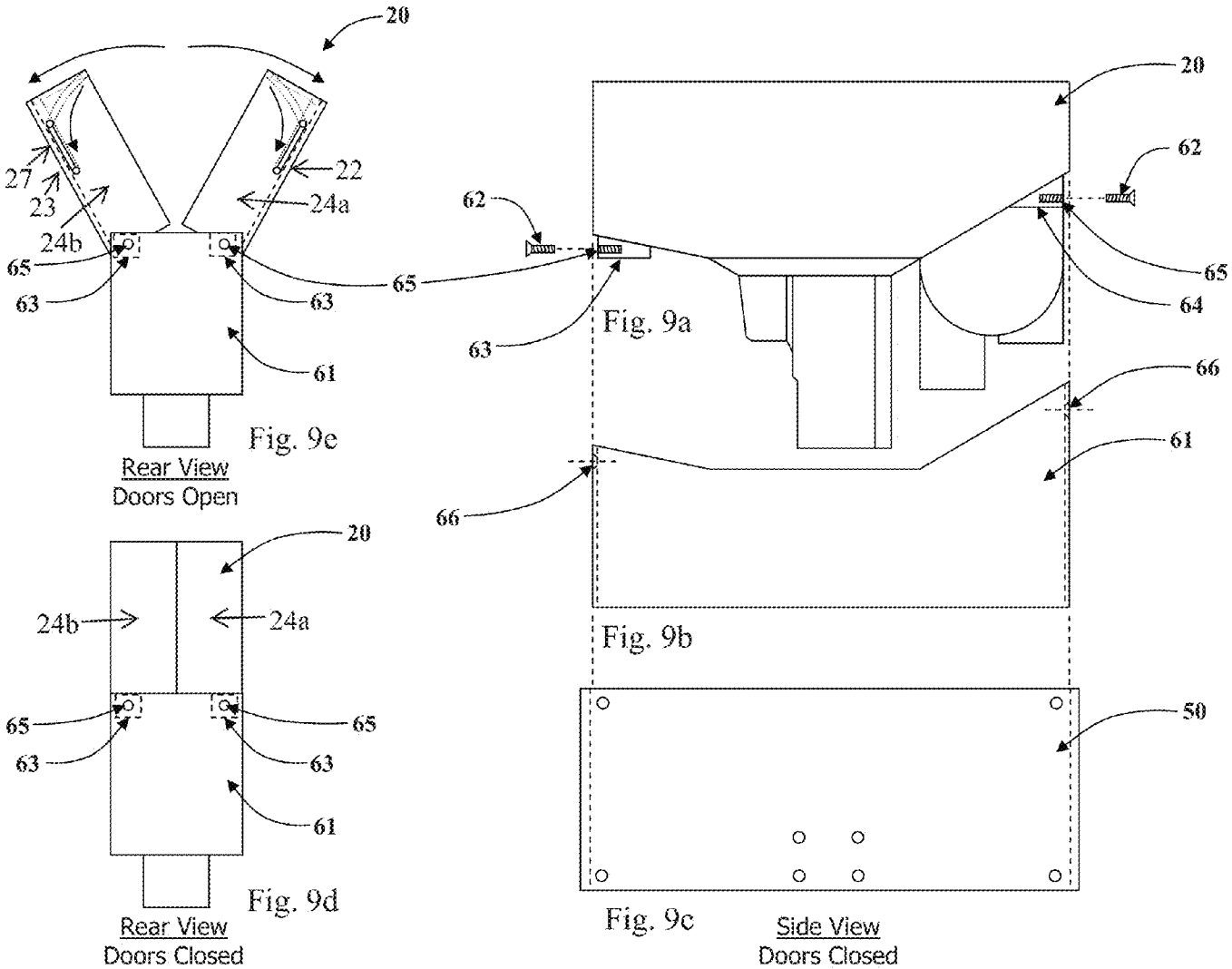
FIGS. 9*a*-9*e* are partial side and rear views of a structural adapter and mounting hardware to couple the locking insert mechanism of FIGS. 7*a*-7*d* to a mating receiver.

FIG. 8 is a partial perspective view of a receiver 50 for use with a locking insert as described above. Receiver 50 includes opposed parallel end walls 51 and 52 that are joined of opposed parallel sidewalls 53 and 54. The internal height, width, and length dimensions of receiver 50 are selected to provide sufficient tolerance to enable insert mechanism 20 to slide into and be housed within the structure of receiver 50. At least one walls 51-54 of receiver 50 has notch portion 55 that provides clearance for an input device 120 (FIGS. 24*a*-24*d*) of a lock control system 129 or for user access to input device 120 of lock control system 129 of insert mechanism 20.

Receiver 50 has a plurality of holes 56 that may be used to mount receiver 50 to a any one of a plurality of external structures, mating interface structures, and to lock the mating locking insert mechanism 20 to receiver 50. In one embodiment, receiver 50 has at least one hole 56, circular counter-bore detent 57, non-circular counter-bore detent 58, and/or polygonal shaped counter-bore detent 59 located on at least one internal wall surface for locking insert mechanism 20 to receiver 50 via lock control system 129. Another embodiment uses a locking guide-rail 60 to guide and to fasten locking insert mechanism 20 to receiver 50. Other structures may be used to facilitate the fastening of locking insert mechanism 20 to receiver 50 such as a motorized ratchet mechanism or other motorized structure, spring, hydraulic, pneumatic, crank and/or other mechanically actuated structures. It is to be noted that receiver 50 is not limited to a rectangular geometric shape or to a structure comprising a limited number of walls, doors, and/or panels. For example, and embodiment comprising a flat, circular, oval, or spherical structure having at least one wall is hereby included. Any feasible geometric shape or structure that can mount or mate with insert mechanism 20 can be utilized and is hereby included.

FIGS. 9*a*-9*e* are partial side and rear views illustrating a structured adapter and mounting hardware suitable for coupling the locking insert 20 at FIGS. 7*a*-7*d* to a mating receiver 50. The outwardly swinging side walls of the insert mechanism 20 of FIGS. 7*a*-7*d* prevent the insert mechanism from fitting completely within receiver 50. Structural adapter 61 has the required dimensions to fit within or on the structure of receiver 50. The upper surfaces of structural adapter 61 are adjacent to the lower surfaces of walls 22, 23, 24*a*, 24*b*, 25*a* and 25*b* of insert mechanism 20. Structural adapter 61 is, therefore, positioned below hinges 28 and 29 and does not impede the movement of walls 22, 23, 24*a*, 24*b*, 25*a*, and 25*b* of insert mechanism 20.

Structural adapter 61 positions the moving portion insert mechanism 20 above the structure of receiver 50. The mounting structure includes a plurality of blocks 63 and 64 having threaded holes 65 and corresponding screws 62. Structural adapter 61 includes a plurality of holes 66 that are positioned to align with the threaded holes 65 of blocks 63 and 64. The mounting of structural adapter 61 to the FIG. 7*a*-*e* insert mechanism 20 can also comprise rivets, welding, glue or any other fastener, adhesive, or bonding process.

Figure 10:
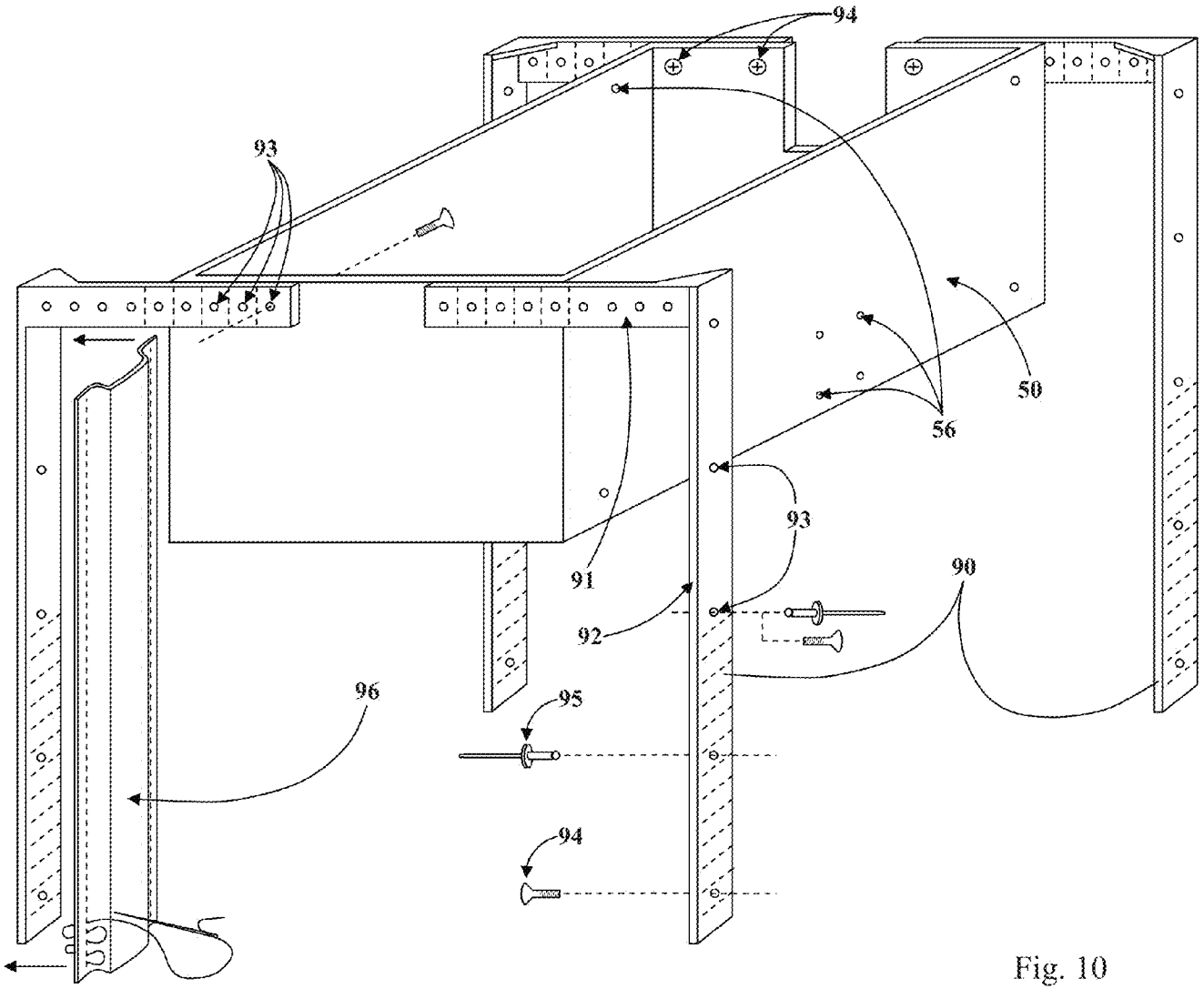
FIG. 10 is a perspective view of a mounting structure for affixing the receiver of FIG. 8 to external structures.

FIG. 10 is a partial perspective view of a mounting structure adapted to affix receiver 50 to a variety of external structures. The structure illustrated in FIG. 10 utilizes a plurality of adjustable stays 90. Each stay 90 is made of a flexible, semi-flexible, or rigid material such as, but not limited to, structural plastic, reinforced thermo plastic, acrylic, glass filled nylon, fiberglass, abs, structural foam, carbon fiber, other polymer material, aluminum, steel, or other metal, etc. or a combination of materials. Each stay 90 may also be comprised of a combination of materials of varying rigidity. Each stay 90 includes at least a first portion 91 that is fastened to a wall section 51-54 of receiver 50 and a second portion 92 that is to be mounted to a structure that is external to the receiver 50 structure e.g. the inner wall section of a bag or purse. As illustrated, stay 90 include a plurality of holes 93 spaced apart at a specified distance and are of a comparable diameter to align with the corresponding plurality of holes 56 in at least one wall section 51-54 of receiver 50. A first member of each stay is fastened to receiver 50 with, but not limited to, at least one screw 94, rivet 95, or other suitable fastener allowing the second member of stay 90 to be positioned flush to or extended away from at least one wall section 51-54 of receiver 50. Each stay 90 can be temporarily or permanently mounted to an external structure with screws, bolts 94, rivets 95, brackets, or leather/fabric sleeves 96. The plurality of stays 90 in combination provides sufficient vertical rigidity to support the combined load of receiver 50, insert mechanism 20, and the items to be housed within insert mechanism 20. Each portion 91 and 92 of stay 90 is made long enough that one or both portions 91 and/or 92 can be cut to desired length in the field.

Figure 11:
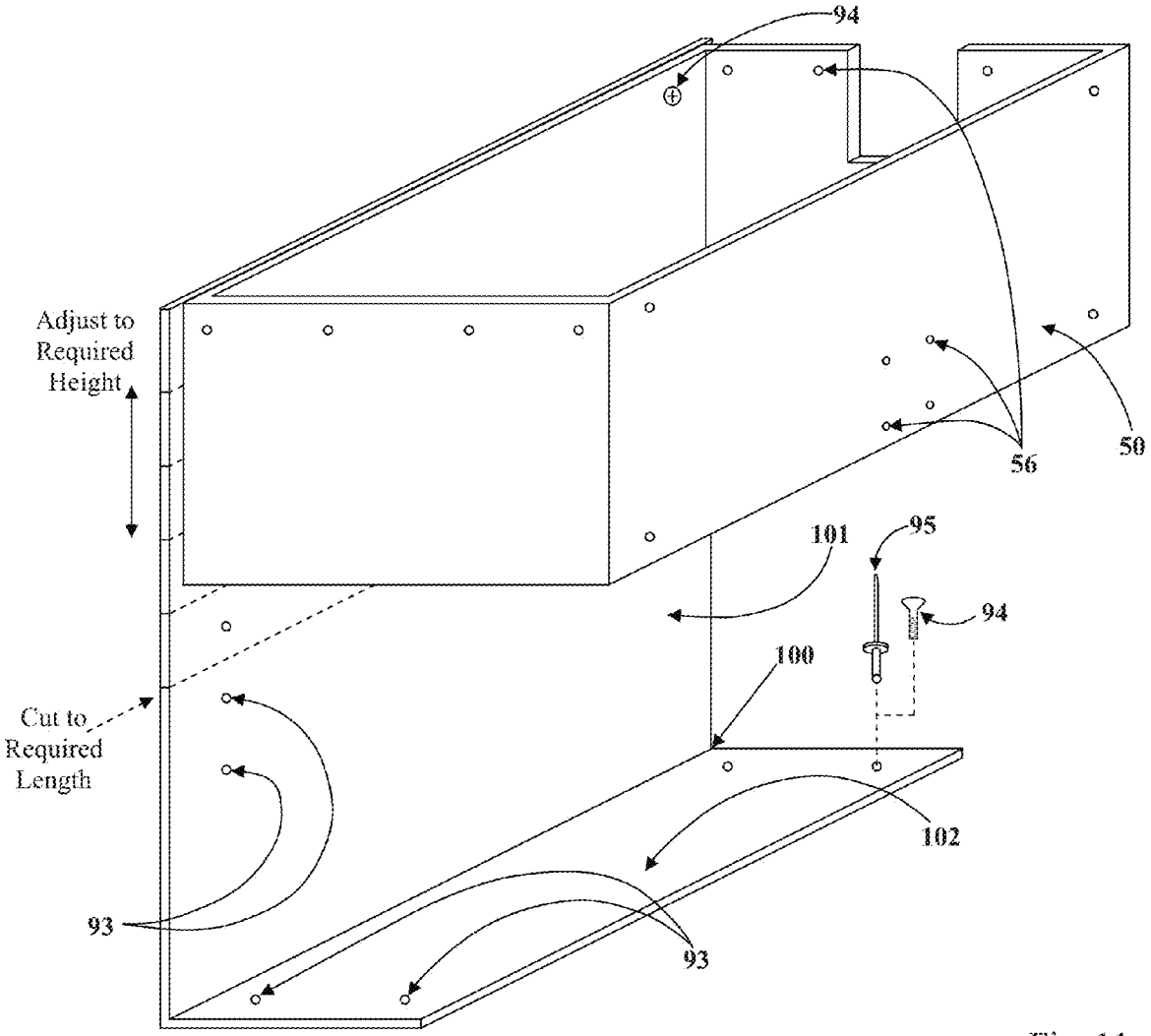
FIG. 11 is a partial perspective view illustrating an alternative mounting structure for affixing the receiver of FIG. 8 to external structures.

FIG. 11 is a perspective view of an alternative structure for affixing receiver 50 to a variety of external structures. As illustrated, an angled mount 100 includes side member 101 and base member 102. Side member 101 has a plurality of holes 93 configured in such a way as to align with at least one of the plurality of holes 56 in at least one wall section 51-54 of receiver 50. At least one fastener including, but not limited to, screw 94, bolt, rivet 95 is used to affix side member 101 of angled mount 100 to receiver 50. It should be noted that side member 101 can also be used to affix angled mount 100 to an external structure.

Base member 102 has a plurality of holes 93 to be used to mount angled mount 100 to an external structure with screws 94, bolts, rivets 95, brackets, leather or fabric sleeves 96. Similar to the mounting structure illustrated in FIG. 10 angled mount 100 can be made of a flexible, semi-flexible, or rigid material such as, but not limited to, structural plastic, reinforced thermo plastic, acrylic, glass filled nylon, fiberglass, abs, structural foam, carbon fiber, other polymer material, aluminum, steel, or other metal, etc. or a combination of materials. When angled mount 100 is affixed to receiver 50 and to an external structure, it provides sufficient vertical rigidity to support the combined load of receiver 50, insert mechanism 20, and the items to be housed within insert mechanism 20. Each side member 101 and base member 102 of angled mount 100 may have a length sufficient such that one or both side member 101 and/or base member 102 can be cut to desired length in the field.

Figures 12A, 12B, 12C:
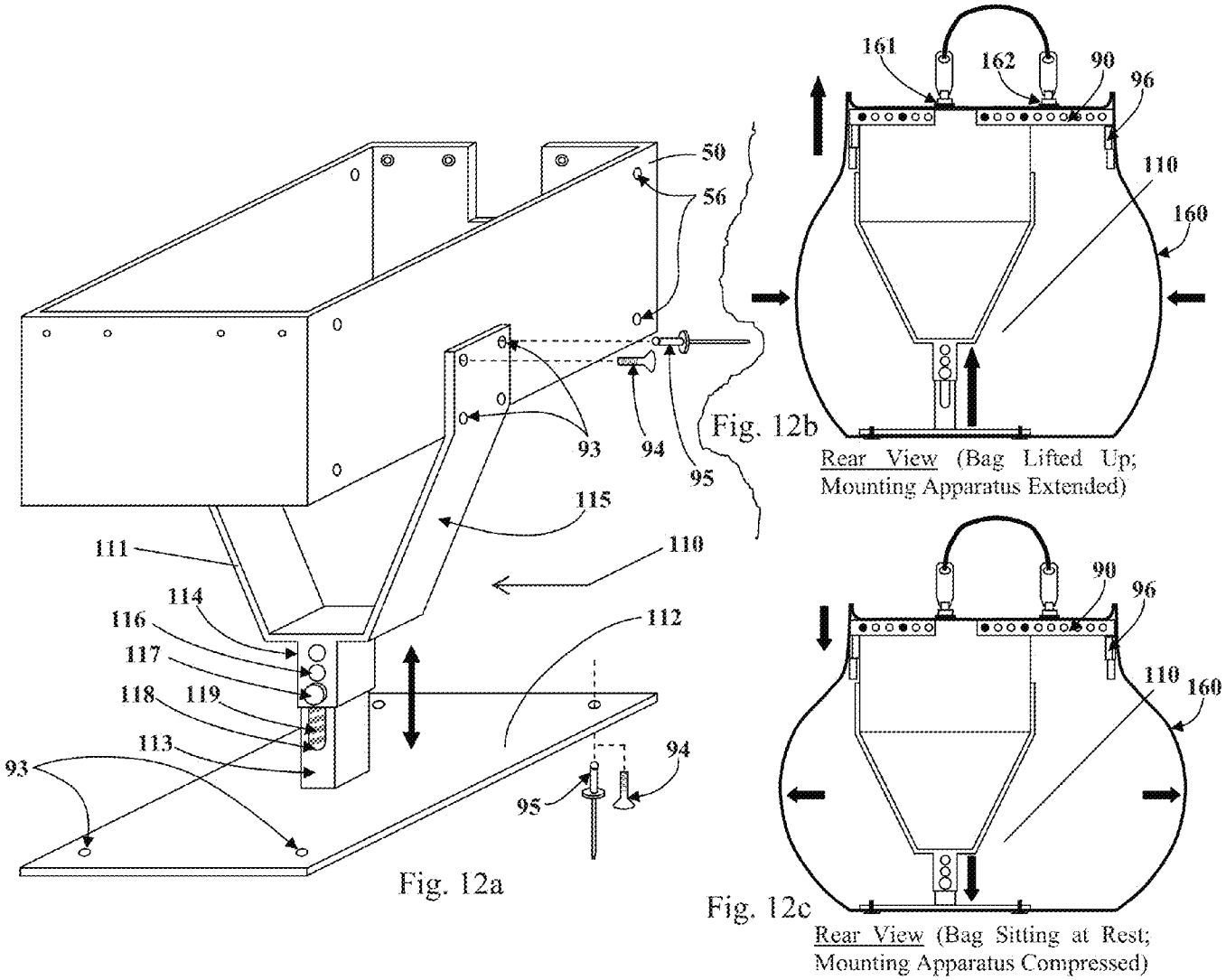
FIG. 12*a* is a partial perspective view of a second alternating structure of affixing the receiver of FIG. 8 to external structures.
FIGS. 12*b* and 12*c* are cross section view illustrating the mounting structure of FIG. 12*a* utilized in a flexible enclosure.

FIG. 12*a* is a perspective view of a second alternative mounting structure for affixing receiver 50 to a variety of external structures. In the embodiment shown in FIG. 12*a*, a vertically pre-loaded mount 110 includes bracket 111, base member 112 and vertical support member 113. Base member 112 has a plurality of holes 93 and is formed from a flexible, semi-flexible, or rigid material such as, but not limited to, structural plastic, reinforced thermo plastic, acrylic, glass filled nylon, fiberglass, abs, structural foam, carbon fiber, other polymer material, aluminum, steel, or other metal, etc. or a combination of materials. Base member 112 mounts vertically pre-loaded mount 110 to an external structure in similar fashion as does base member 102 of angled mount 100.

Vertical support member 113 is affixed to base member 112 with any suitable mounting hardware such as screws 94, rivets 95, etc. During the fabrication process, base member 112 and vertical support member 113 can be molded together as one structure. Alternatively, if the composition of base member 112 and vertical support member 113 are metal, the base and vertical support members may be welded together. Bracket 111 of vertically pre-loaded mount 110 includes a first portion 114 and a second portion 115. First portion 114 and second portion 115 of bracket 111 can be molded together or welded together as one structure, or affixed with any suitable mounting hardware such as screws 94, rivets 95, etc. First portion 114 of bracket 111 is configured in a geometric shape that mates with vertical support member 113 so as to allow the first portion to slide in vertically with minimal or acceptable rotational motion. In the embodiment shown in FIG. 12*a*, members 113 and 114 are fabricated from two rectangular tubes that are configured such that the outside rectangular length and width dimensions of vertical support member 113 is slightly less than the inside rectangular length and width dimensions of first portion 114 of bracket 111. The configuration of members 113 and 114 is not limited to first portion 114 of bracket 111 encompassing vertical support member 113. An alternate embodiment comprises the reverse structure wherein the inside rectangular length and width dimensions of vertical support member 113 is slightly greater than the outside rectangular length and width dimensions of first portion 114 of bracket 111 allowing first portion 114 to fit within vertical support member 113.

The structure of mating vertical support member 113 and first portion 114 of bracket 111 is not limited to a rectangular geometric shape. Any geometric shape or structure that allows the vertically upward and downward movement between bracket 111 and base member 112 of vertically preloaded mount 110 may be utilized. The first portion 114 of bracket 111 comprises at least one hole 116 through one or more surfaces of first portion 114. A pin 117 may be inserted into at least one hole 116 in such a way as to remain fixed in position without loosening or coming out of position. At least one hole 116 of first portion 114 extends completely through two opposing sides of first portion 114 allowing pin 117 to pass completely through opposing sides of first portion 114. Pin 117 is thereby fixed in position being held in position on one side by the head of pin 117 which has a larger diameter than hole 116 and being held in position on the opposing side by for example, a carter pin, snap ring, threaded nut, or other fastener. For security purposes, after the structure of vertically pre-loaded mount 110 is fully assembled, pin 117 can be welded or, in some way, permanently fixed into position.

Vertical support member 113 includes at least one elongated slot 118 and at least one spring 119. Elongated slot 118 is positioned vertically along at least one surface of vertical support member 113 and is contained within the upper and lower vertical dimensions of vertical support member 113. A second elongated slot is formed in an opposing side of vertical support member 113. At least one spring 119 is positioned vertically within support member 113 and has an outside coil diameter that is less than the smallest inside dimension of vertical support member 113.

As illustrated, pin 117 passes through first portion 114 of bracket 111 via at least one hole 116 and also passes through vertical support member 113 via at least one elongated slot 118. When bracket 111 moves in a vertically downward direction, pin 117 eventually comes into contact with the lower most edge of elongated slot 118, limiting the downward vertical travel of bracket 111. When bracket 111 moves in a vertically upward direction, pin 117 eventually comes into contact with the upper most edge of elongated slot 118, limiting upward vertical travel of bracket 111.

A first end of spring 119 is positioned adjacent to the mounting surface between vertical support member 113 and base member 112. Pin 117 is horizontally positioned on top of and adjacent to a second end of at least one spring 119. In this configuration, the weight of bracket 111 in combination with receiver 50, insert mechanism 20, and the contents within insert mechanism 20 are supported by pin 117 as this structure places spring 119 under compression preloading the apparatus. In a different embodiment, the pre-loaded mount includes a combination of springs that are placed in such a way that at least one spring is positioned below pin 117 so as to exert an upward force on pin 117 with at least one spring is positioned above pin 117 between pin 117 and bracket 111 to exert a downward force on pin 117. This configuration places the structure into a neutral loading condition. The springs used in this embodiment do not have to exhibit the same compression and/or tension characteristics. Pads, bushings, or rubber stoppers can be positioned to dampen any noise generated by pin 117 contacting either vertical extreme of elongated slot 118.

A second portion 115 of bracket 111 includes a plurality of holes 93. One or more of holes 93 align with at least one of the plurality of holes 56 in at least one wall section 51-54 of receiver 50. Second portion 115 of bracket 111 is fastened to receiver 50 with, but not limited to, at least one screw 94, rivet 95, or other suitable fastener.

Turning to FIGS. 12*b* and 12*c*, floppy handbag 160 is not designed to have significant vertical support. When a floppy handbag is put down onto a surface, the vertical height of the bag diminishes and the side walls of the purse bulge outwardly. As illustrated in FIG. 12*c*, when a floppy handbag is picked up by its handle(s), the vertical height of the bag increases and the side walls of the purse move in an inward direction as shown in FIG. 12*c*. Mounting a rigid structure to the walls of a floppy handbag 160 will alter the look and basic feel of the bag. FIGS. 12*b* and 12*c* illustrate vertically preloaded mount 110 expanding and compressing in the vertical direction with the vertical movement of handbag 160 so as to not affect the manner in which the side walls of handbag 160 bulge.

Base member 112 is mounted to the bottom floor of handbag 160 with screws 94, rivets 95, leather or fabric sleeves 96 or other suitable fastener or adhesive. Top portion of receiver 50 may be secured to the top portion of the handbag 160 with adjustable stays 90 and leather or fabric sleeves 96. As illustrated, stays 90 are adjusted in such a way as to mount vertically pre-loaded mount 110 off center and closer to one wall of the handbag. Each first portion 91 and second portion 92 of each stay 90 is individually cut as required to fit this application. Handbag 160 has at least one access opening, for example, zipper 161 and 162. As illustrated, the left-hand zipper 161 accesses doors 26 and 27 of insert mechanism 20 the right-hand zipper 162 accesses the inside body of the handbag permitting a user to access items in the insert mechanism as well as the interior of handbag 160.

Figure 13B:
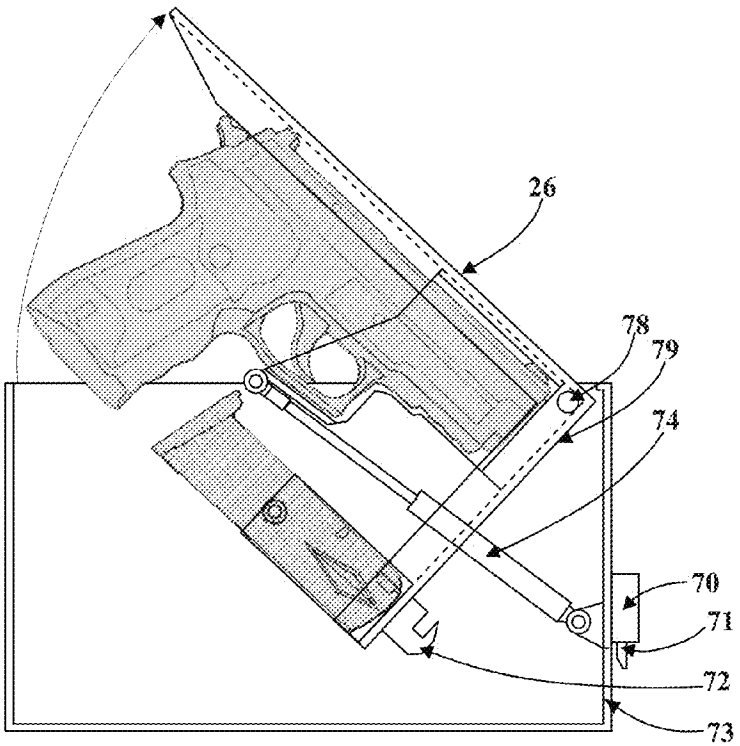
FIGS. 13*a*-13*b* are partial side views of an embodiment of the locking insert mechanism adapted to receive a hand gun or similar item at an angled inclination relative to the bottom wall of the locking insert.
Figure 13A:
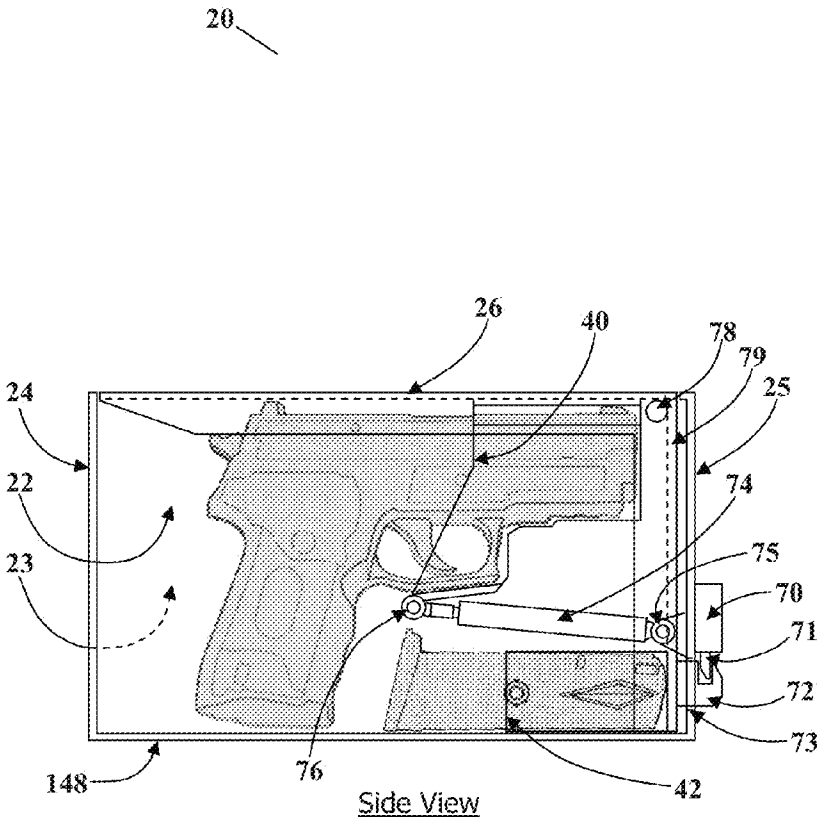

FIGS. 13*a* and 13*b* are partial side views of an embodiment of insert mechanism 20 adapted to receive a hand gun or other item at an angled inclination relative to bottom wall 148 of locking insert 20. Insert mechanism 20 includes walls 22, 23, 24, and 25 and bottom 148. An access door 26 has a base portion 79 affixed to at least one wall 22, 23, 24 or 25. As illustrated, access door 26 and base portion 79 may be constructed from a common piece of 90° c-channel. Access door 26 is coupled to at least one of walls 22, 23, 24, and/or 25 of insert mechanism 20 via pivot pin 78. Encasement portion 40 is attached to access door 26 and base portion 79. In the embodiment shown in FIGS. 13*a* and 13*b* insert mechanism 20 includes an additional encasement portion 42 for storing a magazine or similar item. At least one actuator 74 has a first end portion 75 and a second end portion 76. First end portion 75 of actuator 74 is coupled to the internal structure of at least one wall 22, 23, 24, and/or 25 and/or bottom 148 of insert mechanism 20. Second end portion 76 is coupled to the structure of access door 26, base portion 79, and encasement portion 40 so as to cause access door 26 to rotate outwardly and away from at least one wall 22, 23, 24, and/or 25 and/or bottom 148 on the axis provided by pivot pin 78.

Base portion 79 includes an opening of sufficient size to allow first end portion 75 of actuator 74 to remain attached in its mounted position as the structure of access door 26, base portion 79, and encasement portions 40 and 42 rotate from the fully closed position to the fully open position.

Actuator 74 can be a spring loaded device, a pneumatic or hydraulic device, a magnetically and/or electromagnetically operated device, an electrically energized device such as a motor and/or a combination of similar or various devices. In one embodiment actuator 74 is a rotationally compressed coil spring positioned so that a pivot pin 78 extends through the open core of the spring. A first end of the rotationally compressed coil spring actuator 74 is placed against an internal surface of at least one wall 22, 23, 24, and/or 25 of insert mechanism 20. A second end of the coil spring actuator 74 is placed against the rotating structure of access door 26 and base portion 79.

During assembly, rotationally compressed coil spring actuator 74 is placed into a rotational compressed state when access door 26 is closed. When freely enabled, rotationally compressed coil spring actuator 74 exerts sufficient force to cause access door 26 to rotate outwardly and away from at least one wall 22, 23, 24, and/or 25 and/or bottom 148 on the axis provided by pivot pin 78. A striker plate 72 is rigidly affixed to the structure including access door 26 and base portion 79 and extends through an opening 73 in at least one wall 22, 23, 24, and/or 25 and/or bottom 148 of insert mechanism 20.

Locking mechanism 70 and latch 71 may be mounted to an exterior surface of insert mechanism 20. Locking mechanism 70 can be one or a combination of, a mechanical key locking mechanism, an electrically, mechanically, pneumatically, hydraulically, and/or magnetically actuated locking mechanism. Locking mechanism 70, latch 71, and strike plate 72, may also be mounted and housed inside the enclosure created by walls 22, 23, 24, 25 and bottom 148. Locking mechanism 70 controls latch 71 causing it to retract thereby freeing striker plate 72. The force applied to the structure of access door 26, base portion 79, and encasement portions 40 and 42 by actuator 74 is consequently released allowing access door 22 to rotate around pivot pin 78 until actuator 74 is fully extended or otherwise stopped. As actuator 74 extends, access door 26 swings to a position that provides an opening in the top section of insert mechanism 20 allowing designated user access to the contents therein.

FIGS. 14*a* and 14*b* illustrate an embodiment of insert 20 adapted to receive a hand gun or other item at an orientation parallel to side walls 24 and 25. As illustrated, insert mechanism 20 includes walls 22, 23, 24, and 25 and bottom 148. Access door 26 is located opposite to bottom 148 and is coupled to the upper structure of insert mechanism 20 via a spring-loaded hinge. Moving platform 86 includes at least one encasement portion 40 and is mechanically coupled to slide/glide mechanism 87. A pulley 80 is mounted to a retainer or similar structure 85 in close proximity to access door 26 and wall 25. Tension spring 74 has a first end 75 is affixed to an inside surface of insert mechanism 20 on or near bottom 148 and directly below pulley 80. Cable 82 has a first end 83 attached to second end 76 of spring 74.

Cable 82 extends upward from a second end 76 of spring 74, into the groove that follows the circumference of pulley 80, over the top of pulley 80, and vertically down to moving platform 86. A second end 84 of cable 82 is attached to moving platform 86 at a location near a slide mechanism 87. Striker plate 72 is rigidly affixed to moving platform 86 and extends through an opening 73 in at least one of wall 22, 23, 24, and/or 25 and/or bottom 148 of insert mechanism 20. Door locking mechanism 70 controls latch 71 causing it to retract thereby freeing strike plate 72. The upward force applied to the moving platform 86 by spring 74 is consequently released, moving platform 86, including encasement mechanisms 40 and 42 and contents therein, upward until actuator 74 is fully relaxed or otherwise stopped. Moving platform 86 slides in a vertically upward direction forcing access door 26 to open and allowing a user access to the contents therein. In one embodiment, a pivoting rod member (not shown) has two pivoting ends, a first end affixed to a pivot mount located on an inside surface of access door 26 and a second end affixed to a pivot mount located on moving platform 86, to facilitate opening door 26.

Figures 15A, 15B, 15C:
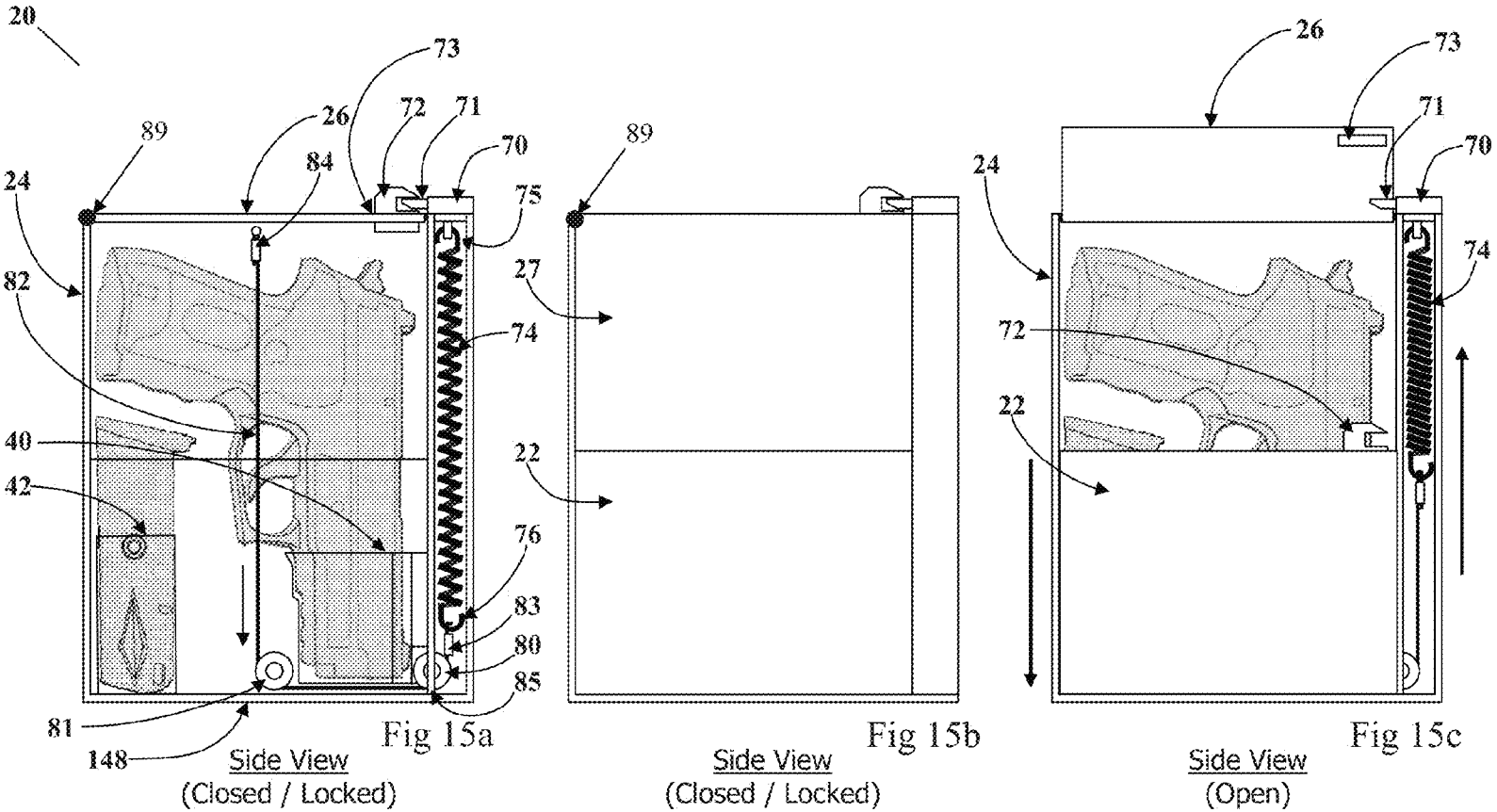
FIGS. 15*a*-15*c* are side views of a drop panel embodiment of a locking insert mechanism of the disclosure.

FIGS. 15*a*-15*c* are partial side views of a drop panel embodiment of insert mechanism 20 including at least one encasement portion 40. As illustrated, insert mechanism 20 includes walls 22, 23, 24, and 25 and bottom wall 148. Access door 26 is located opposite to bottom wall 148 and is coupled to the upper structure of insert mechanism 20 with a spring-loaded hinge 89. The embodiment of locking insert 20 illustrated in FIGS. 15*a* and 15*b* also includes encasement portion 42 adapted to receive a magazine or similar item. A retainer or similar structure 85 is in close proximity to bottom 148 and wall 25. Second pulley 81 is mounted in the same plane as first pulley 80, in close proximity to bottom 148, near the vertical centerline of side wall 22. A tension spring 74 has a first end 75 is affixed to an inside surface of insert mechanism 20 directly above pulley 80. Cable 82 has a first end 83 attached to second end 76 of spring 74. Cable 82 extends downward from a second end 76 of spring 74, into and following the groove that travels the circumference of first pulley 80, continuing horizontally across into and following the groove that travels the circumference of second pulley 81, and then vertically upward. A second end 84 of cable 82 is affixed to a bracket or similar attachment point located high and vertically centered on the inside surface of sliding access door 27. Striker plate 72 is rigidly affixed to the structure of sliding access door 27 and extends through an opening 73 in access door 26 of insert mechanism 20.

A door locking mechanism 70 controls latch 71 causing it to retract thereby freeing striker plate 72. The downward force applied to sliding access door 27 by spring 74 via cable 82 is sliding access door 27 downward until spring 74 is fully relaxed or otherwise stopped. Sliding access door 27 slides in a vertically downward as the spring-loaded hinge 89 causes access door 26 to rotate open in an upward direction allowing the designated user(s) access to the contents of locking insert 20.

Figures 16A, 16B, 16C:
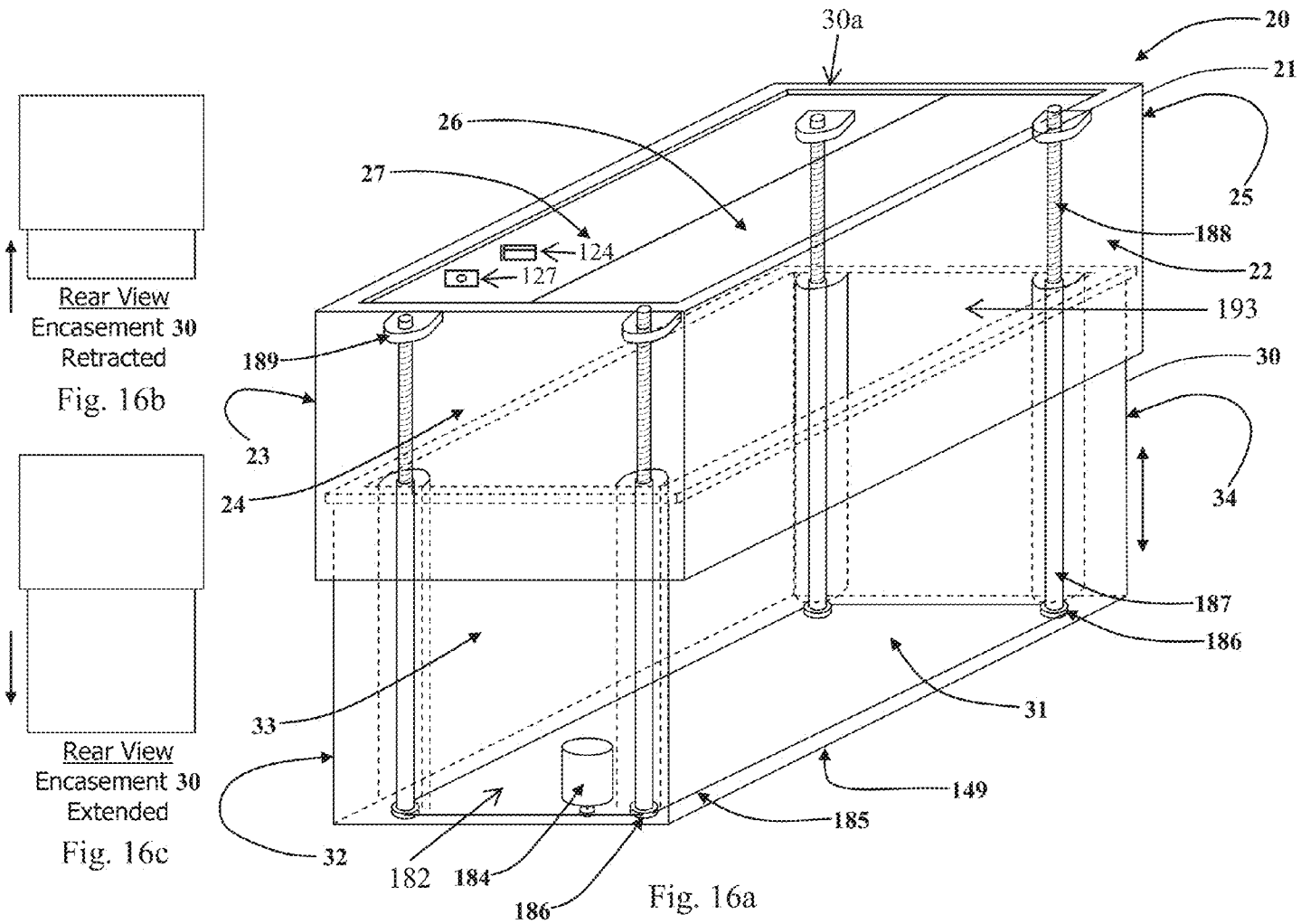
FIGS. 16*a*-16*c* are side, rear and top perspective views of an alternate embodiment of an insert mechanism adapted for depth adjustment.

FIGS. 16*a*-16*c* are rear and perspective views of an alternate embodiment of insert mechanism 20 including a portable locking compartment that houses items such as, but not limited to, jewelry, gems, personal heirlooms, wallet, cash, coins, credit cards, precious metals, keys, cell phone(s), prescription medication, software media, and/or confidential/important documents. The portable locking compartment permits a user to lock and protect personal items when going to the beach, community pool, doctor, and/or hospital, etc. As illustrated, insert mechanism 20 includes an upper encasement 21 having walls 22-25, and at least one door (two illustrated), a vertically lower encasement 30 having walls 31-34, and bottom wall 149. Vertically adjustable lower encasement 30 is configured to accommodate items of various dimensions and quantities.

An internally accessible analog and/or digital input device initiates a trigger to control circuitry to activate auxiliary automatic system generally indicated as 182 to increase or to decrease the depth of locking insert mechanism 20 by moving lower encasement 30 in a vertical direction. Auxiliary system 182 includes at least one electric gear motor w/drive gear/sprocket 184, chain/belt 185, one or more sprockets 186 with threaded tube portion 187, at least one threaded rod 188 and fixed tab 189. An inner bottom wall (not shown) may be used to separate the drive components from variable depth upper compartment 193. Motor 184 drives belt or chain 185 which in turn rotates sprockets 186. Sprockets 186 rotate threaded rods 187 to raise or lower upper portion 30*a* of lower encasement 30. Chain/belt 185 travels around the outside perimeter defined by walls 31, 32, 33, and 34 of lower encasement 30. Chain/belt 185 is chosen, adjusted, or modified to have a length to provide sufficient tension in the drive structure to keep the chain or belt taunt. An adjustable idler pulley or sprocket (not shown) may be utilized to keep the desired tension in chain/belt 185.

The geometry of upper encasement 21 and/or lower encasement 30 of insert mechanism 20 is not limited to a rectangular geometric shape or to a structure comprising a limited number of walls, doors, and/or panels. For example, and embodiment comprising a circular, oval, or spherical structure having at least one wall is hereby included. Any feasible geometric shape or structure including but not limited to a non-symmetrical structure may be utilized. In another embodiment, a plurality of encasements and mounting structures are mounted within locking insert mechanism 20 to separately house and/or secure various items.

Figures 17A, 17B, 17C, 17D, 17E:
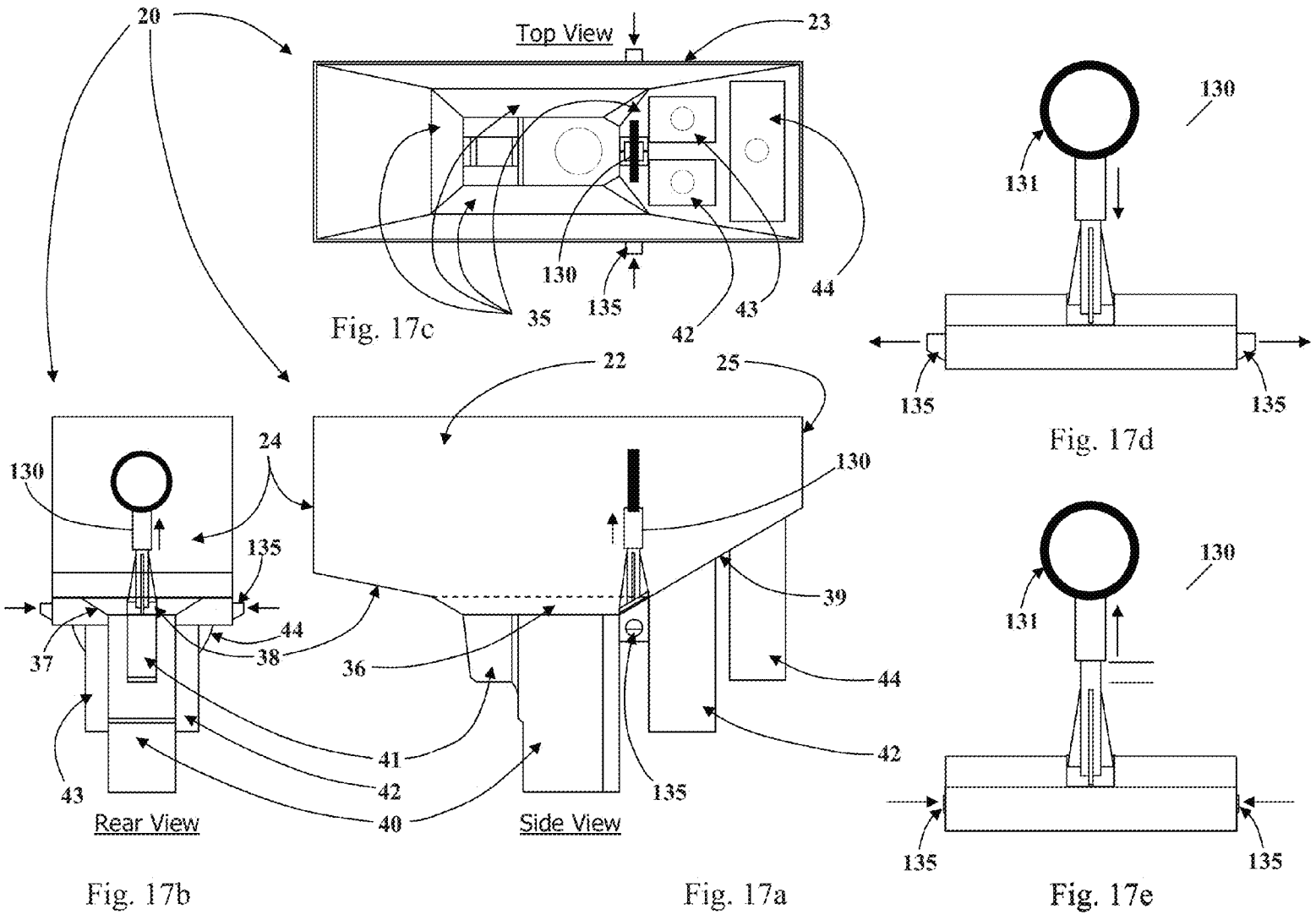
FIGS. 17*a*-17*c* are partial side, rear and top views, respectively, of the locking insert mechanism of FIGS. 3*a*-3*d* further illustrating the locking mechanisms.
FIGS. 17*d* and 17*e* are partial end views of the locking mechanism of FIGS. 17*a*-17*c;*

FIGS. 17*a*-17*c* are partial side, rear, and top views, respectively, of the locking insert mechanism 20 of FIGS. 3*a*-3*d* illustrating dock lock 130 with portions omitted for clarity. FIGS. 17*d* and 17*e* are rear views of dock lock 130 further illustrating knob 131 and at least one actuator 135.

Lifting knob 131 in an upward direction causes actuator(s) 135 to retract into the structure of dock lock 130. This in turn disengages locking insert mechanism 20 from receiver 50 (FIG. 8) allowing the two structures to be separated.

Dock lock 130 is positioned near the center of gravity of locking insert mechanism 20. An upward force applied to knob 131 of dock lock 130 performs a dual functionality of disengaging the locking structure of locking insert mechanism 20 and simultaneously lifting and separating locking mechanism 20 from receiver 50. In other embodiments, more than one dock locks 130 with locking insert mechanism 20 may be used. For example, a first dock lock 130 may be located in close proximity or adjacent to an inside wall 24 of insert mechanism 20 with a second dock lock 130 located in close proximity or adjacent to an inside wall 25 of insert mechanism 20.

Figure 18A:
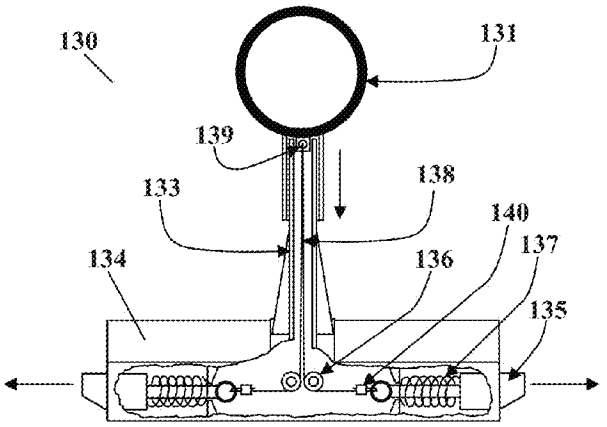
FIGS. 18*a*-18*c* are partial cut-away views further illustrating a docking lock according to the disclosure in locked and unlocked positions.
Figure 18C:
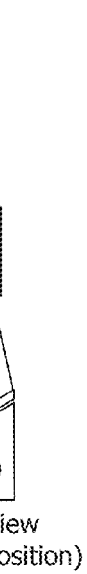
Figure 18B:
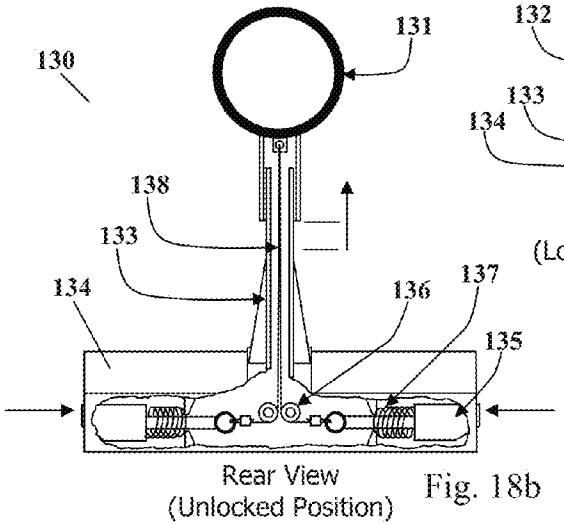

FIGS. 18*a*-18*c* are partial cut away rear and side views of dock lock 130 of FIGS. 17*a*-17*c*. As illustrated, dock lock 130 includes knob 131, support tube 133, actuator housing 134, at least one actuator 135, one or more pulleys 136, at least one spring 137, and one or more cables 138. Each spring 137 is configured to impose an outwardly directed force onto its respective actuator 135. Cable 138 has a first end 139 attached to knob 131 and a second end 140 attached to an inside portion of a respective actuator 135. Cables 138 follow a portion of the grooved circumference of a respective pulley(s) 136. Exerting a vertically upward force on knob 131 slides the knob upwardly along support tube 133 pulling cables 138 in an upward vertical direction. Cables 138 pull actuators 135 to move in worldly, retracting the actuators into actuator housing 134 of dock lock 130. As each actuator 135 retracts into actuator housing 134 of dock lock 130 the actuators simultaneously move out of a counter bored detent 57 in at least one wall 51-54 of receiver 50 unlocks insert mechanism 20 from receiver 50. The vertically upward force applied to knob 131 also lifts and/or moves locking insert 20 away from receiver 50. In is to be noted that the terms "upward vertical direction," "vertically upward," "vertical force," "lift up," "horizontal force," and other direction specific terms are relative to the mounted three dimensional, rotational, position of locking insert mechanism 20 and receiver 50.

As illustrated, an outwardly facing end of actuator 135 is rounded or beveled in such a way that the rounded or beveled end presents a ramped surface to one or more inner wall portion(s) of at least one wall 51-54 of receiver 50 facilitating engagement of the actuator. As locking insert mechanism 20 is moved toward receiver 50, the ramped surface of one or more actuators 135 come into contact with at least one inner wall portion of one or more walls 51-54. The continued downward force exerted onto locking insert mechanism 20 after the point of contact applies a portion of the force applied to actuators 135 to be directed inwardly, compressing springs 137 and causing each actuator 135 to retract into actuator housing 134 of dock lock 130. This provides the required clearance for locking insert mechanism 20 to move into the docked position with regards to receiver 50. When locking insert mechanism 20 is in the docked position, an outward end portion of one or more of actuators 135 is physically aligned to a respective counter-bored detent 57 in at least one wall 51-54 of receiver 50 (FIG. 8). The outwardly directed force imposed onto at least one actuator 135 by a respective spring 137 causes the actuator 135 to move in an outward direction, extending beyond at least one external wall surface 22-25 of locking insert mechanism 20 and into a respective counter bored detent 57 in at least one wall 51-54 of receiver 50. Locking insert mechanism 20 and receiver 50 are thereby engaged in a docked and locked position.

Figure 19A:
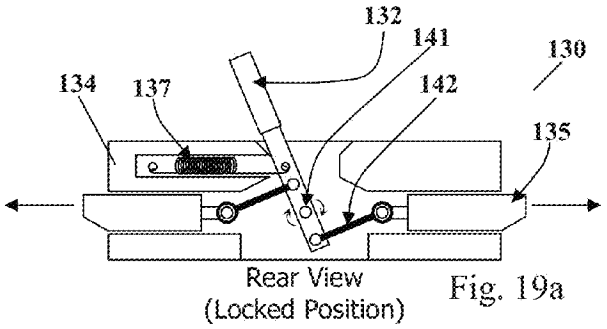
FIGS. 19*a*-19*b* are partial side views illustrating an alternative docking lock in locked and unlocked positions.
Figure 19B:
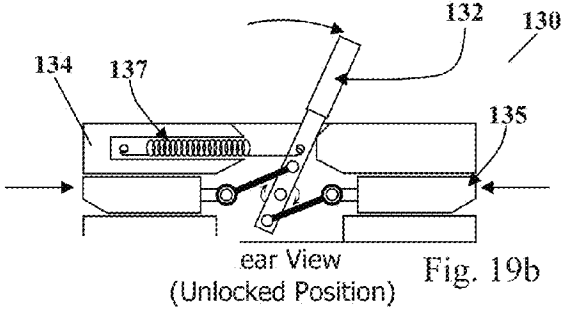

FIGS. 19*a*-19*b* are partial side views of a second embodiment of dock lock 130 including lever 132, axle 141, at least one connecting rod 142, at least one actuator 135, at least one spring 137 and actuator housing 134. One end of lever 132 extends from actuator housing 134 so as to provide a user access to an end of the lever. Axle 141 is rotatably affixed to the internal structure of actuator housing 134. Lever 132 is coupled to axle 141 such that lever 132 pivots on the axle causing the end of lever 132 to move in an arc. One or more connecting rods 142 have a first end coupled to lever 132 at a distance away from axle 141 with a second end coupled to a respective actuator 135. Moving the end of lever 132 in a first direction applies a force to each connecting rod 142 causing connecting rod 142 to move a respective actuator 135 to a position extending from actuator housing 134 of dock lock 130. Moving the end of lever 132 in a second, opposite direction applies a force to each connecting rod 142 causing connecting rod 142 to move a respective actuator 135 to a position retracted into actuator housing 134 of dock lock 130. Moving the end of lever 132 in the first direction thereby extends at least one actuator 135 in a direction outward from locking insert mechanism 20 and into the opening of counter-bored detent 57, 58, or 59 in at least one wall 51-54 of receiver 50 (FIG. 8). When locking insert mechanism 20 is positioned into a docked position with receiver 50, moving the end of lever 132 in the first arced direction locks coding insert 20 to receive 50. Moving the end of lever 132 in the second direction retracts at least one actuator 135 in a direction inward to locking insert mechanism 20 and away from the opening of counter-bored detent 57, 58, or 59 in at least one wall 51-54 of receiver 50. Moving the end of lever 132 in the second arced direction thereby unlocks locking insert mechanism 20 from receiver 50 and enables the two units to be separated.

A first end of at least one spring 137 is attached to actuator housing 134 of dock lock 130. A second end of at least one spring 137 is attached to lever 132 at a distance away from the coupling location of axle 141 to lever 132 in such a way as to place at least one spring 137 under a tension thereby applying a force to lever 132 and causing the end of lever 132 to move in the first direction. An outwardly facing end of each actuator 135 is rounded or beveled in such a way to facilitate engagement of locking insert 20 with at least one wall 51-54 of receiver 50. Actuator(s) 135 may be made from a flat material such as but not limited to metal plate stock of sheet metal rather than a round or square stock material. The utilization of such a flat stock material allows the structure of dock lock 130 to be made significantly narrower.

Figures 20A, 20B, 20C:
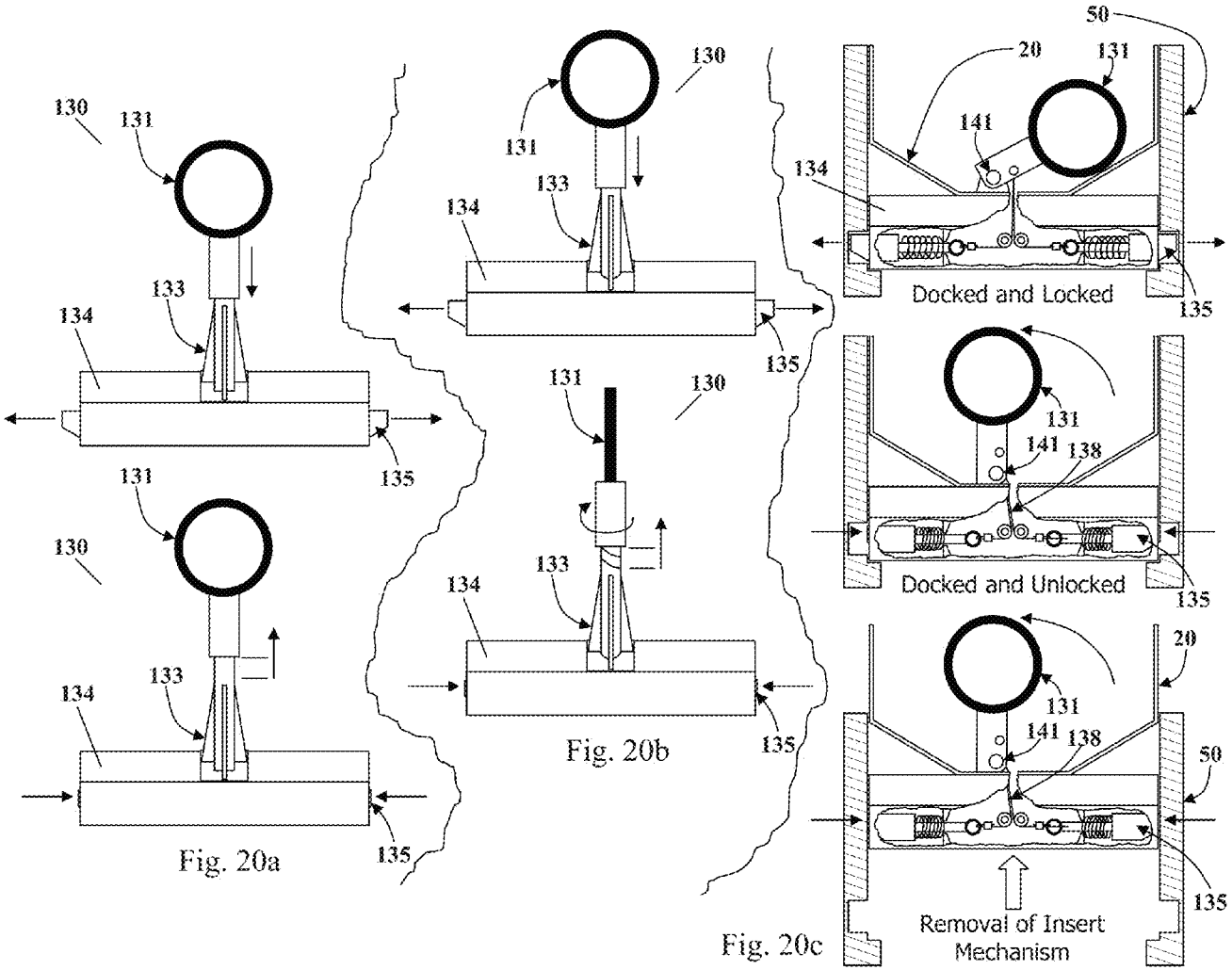
FIGS. 20*a*-20*c* are partial side and side cut away views of alternative embodiments of the dock lock.

FIGS. 20*a*-20*c* are partial side and side cut away views of embodiments of dock lock 130. The embodiment shown in FIG. 20*a* has been described in detail above in connection with FIGS. 18*a*-18*c* illustrated for reference purposes. The embodiments shown in FIGS. 20*b* and 20*c* disclose alternative structures of knob 131. One embodiment of dock lock 130 as illustrated in FIG. 20*b* comprises support tube 133 having a threaded portion at the end that couples to knob 131. Knob 131 has machine threads that mate to the corresponding treads of support tube 133. Twisting knob 131 in a first rotational direction causes knob 131 to unscrew from stationary support tube 133 thereby causing the knob to move in an upward direction. Twisting knob 131 in a first direction thereby causes at least one actuator 135 to retract into the actuator housing 134 of dock lock 130 as described in connection with FIGS. 18*a*-18*c*. FIG. 20*c* is a cross sectional rear view of an alternate embodiment of dock lock 130 mounted in locking insert mechanism 20. Locking insert mechanism 20 is illustrated in the docked and locked position (FIG. 20*c* upper diagram), in the docked and unlocked position (FIG. 20*c* middle diagram), and in the unlocked, removal position (FIG. 20*c* lower diagram). FIG. 20*c* includes the dock lock 130 of axle 141 that is rotatably affixed to the structure of actuator housing 134 of dock lock 130 and is coupled to knob 131 so as to enable knob 131 to pivot back and forth in two directions. A first end of cable 138 is attached to knob 131 at a distance away from the coupling location of axle 141. Moving knob 131 back and forth in first and second directions retracts and releases actuator 135 to engage and disengage receiver 50 as cable 138 pulls and releases the actuators. As illustrated, actuators 135 are spring loaded so as to bias knob 131 in an unlocked position.

Figures 21, 22A, 22B, 23:
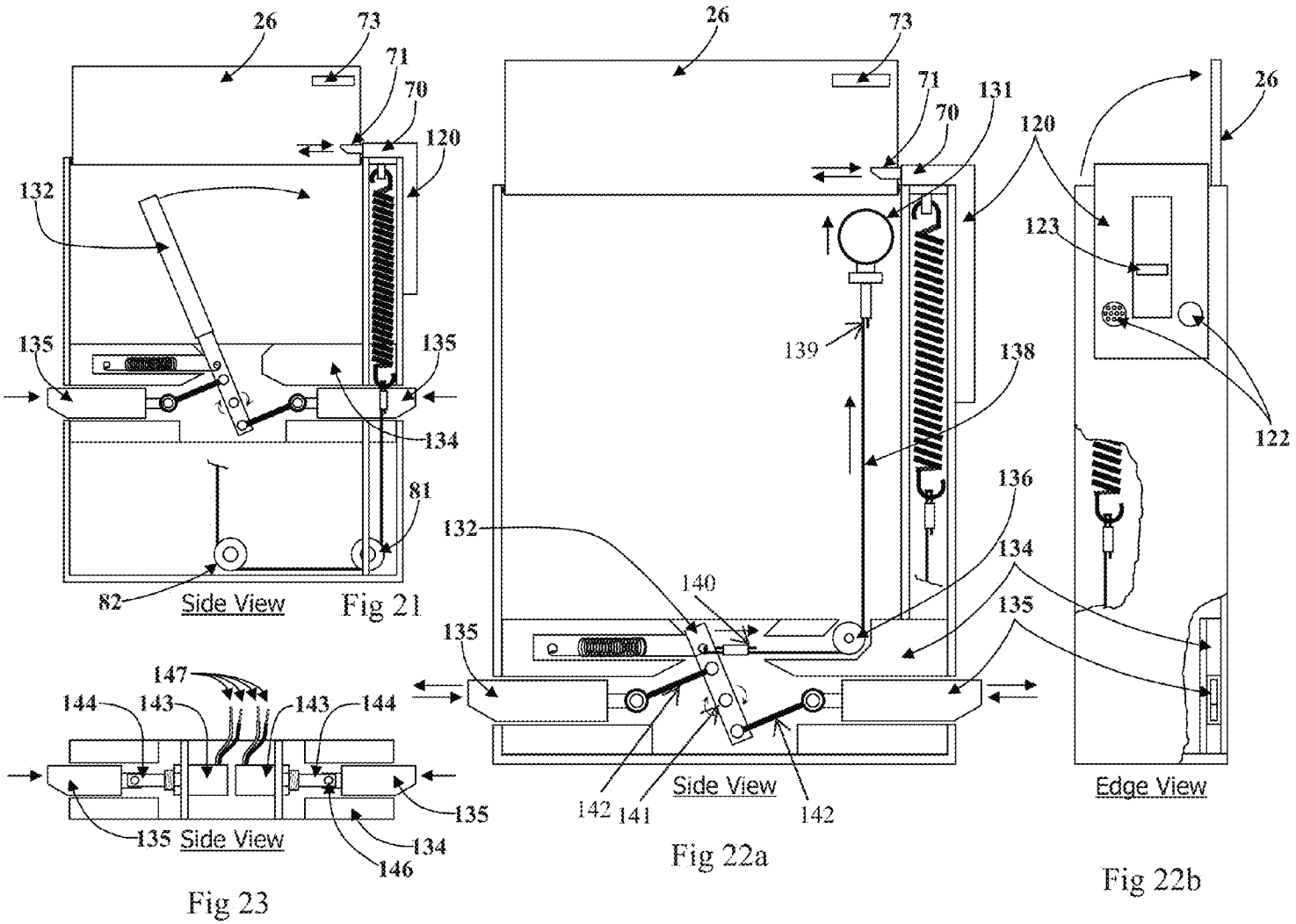
FIG. 21 is a partial side view of the dock lock at FIGS. 19*a*-19*b* mounted in the locking insert mechanism of FIGS. 15*a* and 15*b;*
FIGS. 22*a* and 22*b* are partial side and edge views of one embodiment of a dock lock mounted in the locking insert mechanism of FIGS. 15*a* and 15*b;*
FIG. 23 is a side view of an embodiment of a dock lock including one or more electrically activated solenoids.

FIG. 21 is a partial side view of the dock lock at FIGS. 19*a*-19*b* mounted in the locking insert mechanism 20 of FIGS. 15*a* and 15*b* with portions omitted for clarity.

FIGS. 22*a* and 22*b* are partial side and edge views of one embodiment of dock lock 130 mounted in the locking insert mechanism 20 of FIGS. 15*a*-15*c*. The dock locking mechanism shown is a combination of the FIG. 18*a*-FIG. 18*c* and FIG. 19*a*-FIG. 19*c* embodiments. As illustrated, a second end 140 of cable 138 is attached to lever 132 at a distance away from the location that axle 141 is coupled to lever 132. Cable 138 extends around a portion of the grooved circumference of pulley 136 and attaches to knob 131 via a first end 139 of cable 138. An upward force applied to knob 131 causes knob 131 and a first end 139 of cable 138 to move in a vertically direction. Pulley 136 directs cable 138 horizontally to lever 132, exerting a horizontally directed force onto lever 132 causing the lever to pivot around axle 141 and move one or more connecting rods 142. Connecting rods 142 drive actuator 135 in an inward direction and retract into actuator housing 134 of dock lock 130.

Figure 25:
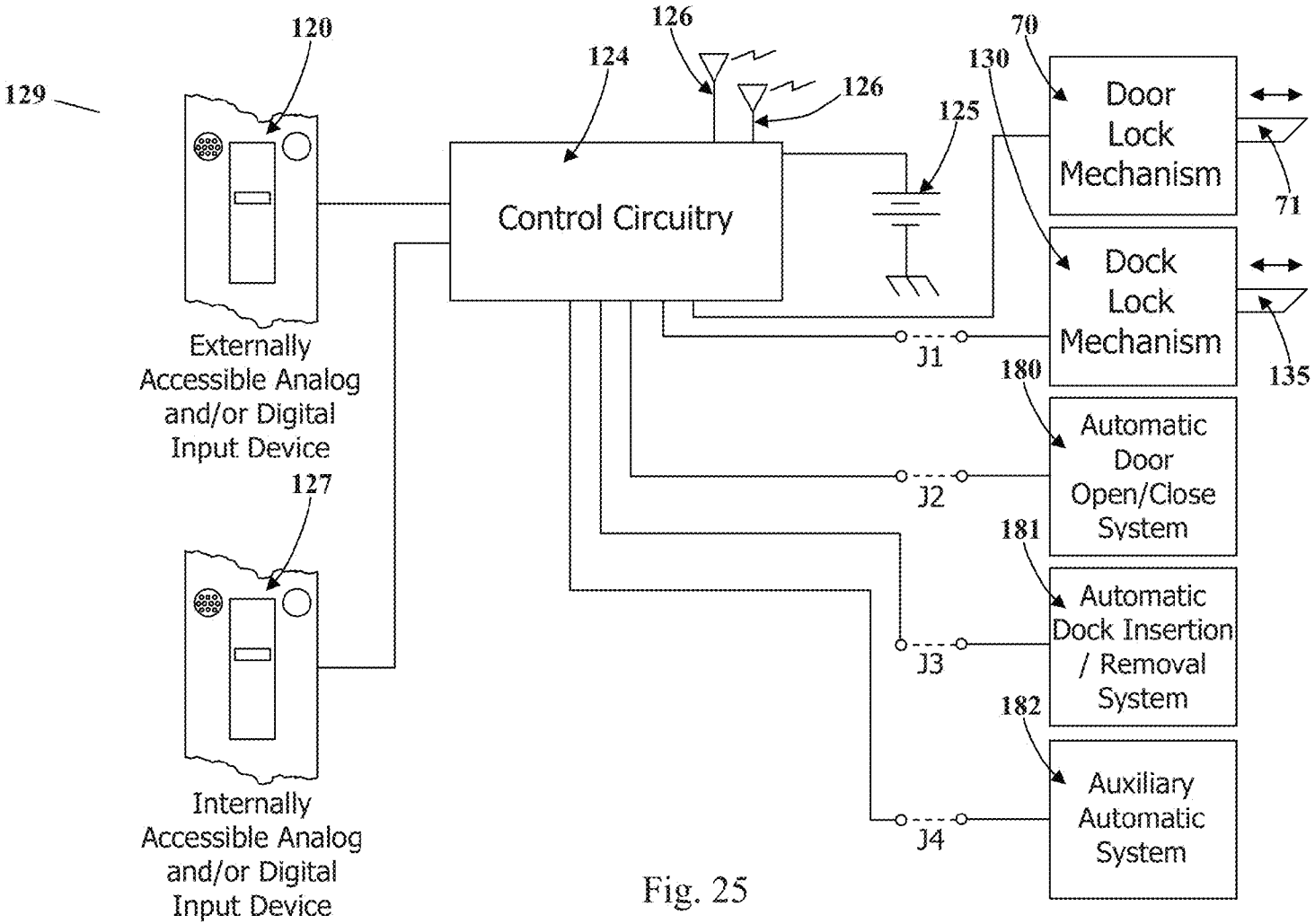
FIG. 25 is a block diagram illustrating a lock control system according to the disclosure.

FIG. 23 is a side view of an embodiment of dock lock 130 including one or more electrically activated solenoids 143 with extended shafts 144 that control the extension and retraction function of one or more actuators 135. Solenoids 143 are mounted or affixed within the structure of actuator housing 134 of dock lock 130. At least one wire 147 of each solenoid 143 is connected to control circuitry 124 of lock control system 129 (FIG. 25). Control circuitry 124 of lock control system 129 energizes or de-energizes at least one wire 147 causing respective shaft 144 of each solenoid 143 to extend in an outward direction or retract in an inward direction. The direct coupling of each shaft 144 to a respective actuator 135 of dock lock 130 causes each respective actuator 135 to extend in an outward direction or retract in an inward direction thereby locking and unlocking insert mechanism 20 to receiver 50. It is to be noted that many electrically activated solenoids are manufactured as a normally extended or normally retracted structure. Preferably, electrically activated solenoids 143 are normally extended, requiring no energy for control circuitry 124 to cause dock lock 130 to remain in the locked mode. Energy is only required to be supplied by control circuitry 124 to each electrically activated solenoid 143 via wire(s) 147 for a predetermined duration of time necessary to unlock and physically separate locking insert mechanism 20 from receiver 50.

FIGS. 24*a*-24*d* are partial front views of externally accessible input devices 120 suitable for use with lock control system 129. FIG. 25 is a block diagram illustrating the configuration of a lock control system suitable for use with locking inset and receiver disclosed herein. Referring to FIGS. 24*a*-24*d* and FIG. 25, externally accessible input device 120 initiates a trigger to control circuitry 124 to (1) actuate access door locking mechanism 70 to lock and/or unlock access doors 26 and/or 27 of locking insert mechanism 20 and/or (2) to actuate dock locking mechanism 130 to lock insert mechanism 20 and receiver 50 after docking has occurred and/or to unlock insert mechanism 20 from receiver 50 to separate the units. In other embodiments, purely mechanical locking structures may also be utilized. For example, a mechanical locking system such as a manual lock and key can be utilized as a sole locking structure or can be utilized in addition to other locking structures for secondary fail-safe purposes such as a primary electronic lock system failure.

Figures 24A, 24B, 24C, 24D:
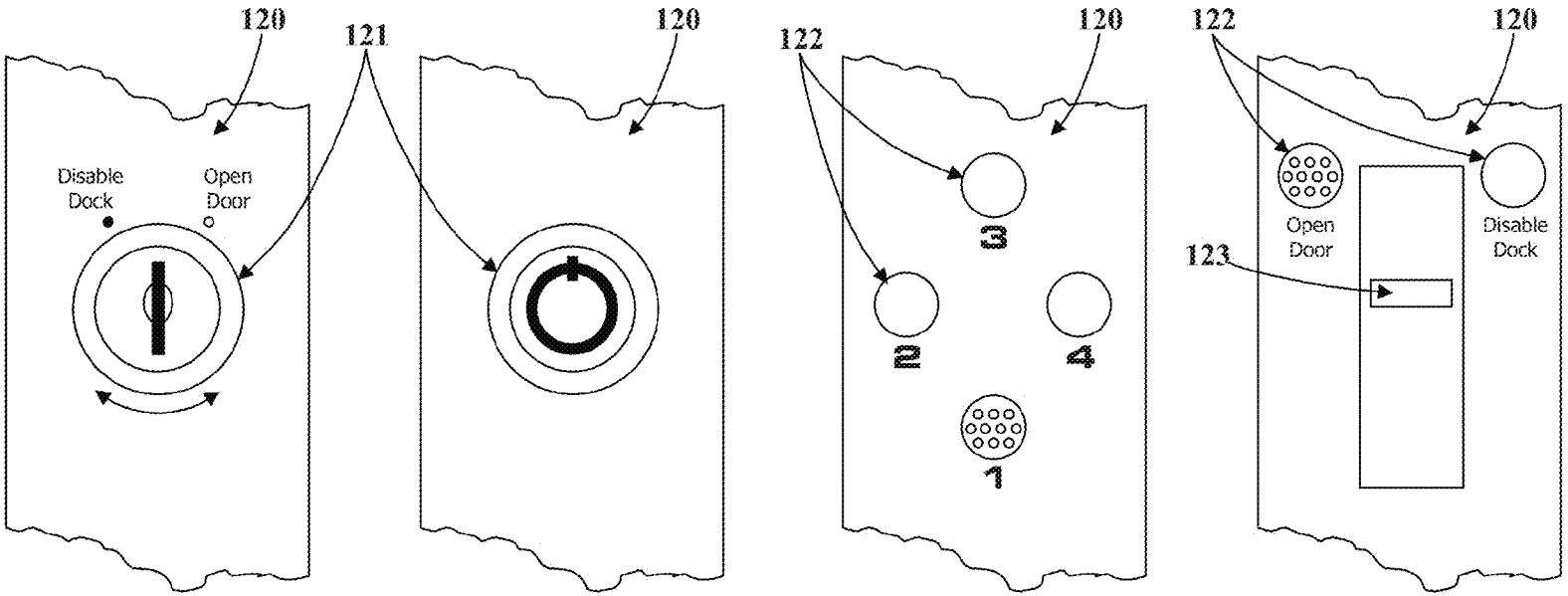
FIGS. 24*a*-24*d* are partial front views of externally accessible input devices suitable for use with a lock control system according to the disclosure.

FIG. 24*a* illustrates an externally accessible input device 120 including a momentary ON-OFF-ON analog key switch 121. Inserting the key into the analog key switch 121 and momentarily rotating it in a first direction initiates a trigger to control circuitry 124 to activate at least one door locking mechanism 70 to retract latch 71 enabling at least one access door 26 and/or 27 of insert mechanism 20 to open. Inserting the key into the analog key switch 121 and momentarily rotating it in a second direction initiates a trigger to control circuitry 124 to activate at least one dock lock mechanism 130 to retract latch 135 enabling insert mechanism 20 to be removed from its mating receiver 50. This embodiment utilizes spring loaded latches 71 and 135 that physically retract then extend due to an inward linear force exerted and then removed when access door 26/27 is manually pushed closed and when insert mechanism 20 is manually inserted into receiver 50. Another embodiment of analog key switch 121 includes at least one additional switch or button 122 configured in such a way that the activation of switch or button 122 in combination with the activation of a first and/or a second direction of rotation of analog key switch 121 initiates a trigger to control circuitry 124 to close at least one access door 26 and/or 27 with an electric motor or similar actuating means. This method also applies in an embodiment utilizing a motorized or similar mechanism that automatically retracts insert mechanism 20 into receiver 50 and/or ejects mechanism 20 from receiver 50.

FIG. 24*b* illustrates an externally accessible input device 120 including momentary ON-OFF-ON analog barrel key switch 121. Analog barrel key switch 121 operates in essentially the same manner as key switch 121 of FIG. 24*a*.

FIG. 24*c* illustrates an externally accessible input device 120 comprising at least one momentary OFF-ON analog pushbutton switch 122. The at least one analog pushbutton switch 122 is depressed in a repetitive pattern of switch closures or a plurality of pushbuttons 122 are actuated in a first pre-defined sequence establishing a coded message to be sent requesting control circuitry 124 to activate at least one door locking mechanism 70 to retract latch 71 allowing access door 26 and/or 27 of insert mechanism 20 to open. When the plurality of pushbuttons 122 are actuated in a in a second pre-defined sequence, a different coded message is sent requesting control circuitry 124 to activate at least one dock lock mechanism 130 to retract latch 135 allowing insert mechanism 20 to be removed from mating receiver 50. In another embodiment, actuating a plurality of pushbuttons 122 using the same sequence of pushbuttons on a second occasion sends a signal to control circuitry 124 to close at least one access door 26/27 via a structure comprising an electric motor or similar mechanism. The method also applies to an embodiment including a motorized or similar mechanism that automatically retracts insert mechanism 20 into receiver 50 and/or automatically ejects mechanism 20 from receiver 50.

FIG. 24*d* illustrates a lock control system 129 including an externally accessible input device 120 having a digital fingerprint scan/recognition device 123. In one variation, access door 26 and/or 27 is allowed to open when digital fingerprint scan/recognition device 123 identifies an authorized user. Other biometric recognition devices, such as a retinal scanner, a palm vein scanner, and/or a facial scanner, etc. may be used. Another implementation uses at least one analog switch or button 122 in combination with digital fingerprint scan/recognition device 123. The identity of an authorized user is first verified and accepted by digital fingerprint scan/recognition device 123 and upon verification, at least one switch/button 122 is actuated to initiate a trigger causing control circuit 124 to activate one or more, but not limited to, locking mechanism(s) 70 and/or 130. The activation of a first switch/button 122 initiates a trigger causing control circuitry 124 to activate at least one door lock mechanism 70 to retract latch 71 thereby enabling at least one access door 26 and/or 27 of insert mechanism 20 to open. The activation of a second switch/button 122 initiates a trigger causing circuitry 124 to activate at least one dock lock mechanism 130 to retract latch 135 thereby allowing the separation of insert mechanism 20 from receiver 50. In another embodiment, after verification of an authorized user by digital fingerprint scan/recognition device 123, actuating at least one pushbutton 122 on a second occasion sends a request to control circuitry 124 to close at least one access door 26/27 with an electric motor or similar system. The method also applies in an embodiment including a motorized or similar mechanism that automatically retracts insert mechanism 20 into or toward receiver 50 and/or automatically ejects mechanism 20 from receiver 50.

FIG. 25 is a block diagram illustrating lock control system 129 including an externally accessible analog and/or digital input device 120, internally accessible analog and/or digital input device 127, control circuitry 124, power source 125, optional antenna 126, door lock mechanism 70 with latch 71, dock lock mechanism 130 with latch 135 and a plurality of automatic systems 180, 181, and 182. As described in detail above in connection with the external input devices 120 of FIGS. 24*a*-24*d*, an externally accessible analog and/or digital input device 120 is a user interface device that initiates a trigger causing control circuitry 124 to activate one or more lock mechanisms and/or systems. The trigger may be initiated by a wireless device such as a radio frequency transmitter or transceiver, a transponder, a GPS device, a RFID device, and/or initiated via other proximity activated devices. At least one antenna 126 receives and/or transmits wireless data from and/or to one or more of these wireless systems, networks, and/or devices. In one embodiment, a wireless system such as a radio transmitter/transceiver or a wireless proximity device is used to initiate a trigger to cause control circuitry 124 to activate a wireless transmitter to transmit a signal to a remote wireless transmitter/transceiver system. Lock control system 129 controls the operation of door lock mechanism 70 to activate the locking and/or unlocking of at least one access door 26/27 and dock lock mechanism 130 to activate the locking and/or unlocking of insert mechanism 20 to receiver 50. System 129 may also control a plurality of other automatic systems and devices including automatic systems 180, 181, and 182.

One embodiment of the above mentioned radio transmitter/transceiver and/or wireless proximity device includes a notification/alert signal initiated by control circuitry 124 to at least one of the authorized user, security authorities, or wireless tracking system in the event that insert lock mechanism 20 has been wrongfully or unintentionally removed from the authorized user. Upon the determination of a wrongful or unintentional separation event, control circuitry 124 initiates at least one of an audible alarm, a wireless signal transmitted to a remote receiver, a signal to initiate geographical location tracking of locking insert mechanism 20 via GPS or other wireless tracking technology. The wrongful or unintentional separation event is determined by control circuitry 124 when a defined distance between the authorized user and insert lock mechanism 20 has been exceeded or when a wireless communication signal strength level between the authorized user and the device has fallen below a predetermined minimum level.

Automatic system 180 is configured to automatically open and/or close at least one access door 26/27 with an electric motor or similar device. Automatic system 181 is configured to automatically retract insert mechanism 20 into or toward receiver 50 and/or to automatically extend insert mechanism 20 from receiver 50 with an electric motor, solenoid or similar device. In one embodiment, auxiliary automatic system 182 alters the depth dimension of the locking insert mechanism 20 of FIGS. 16*a*-16*c* utilizing an electric motor or similar device.

In different embodiments, two or more lock systems are utilized in connection with the locking insert mechanism and receiver disclosed herein. A first lock system is the access door lock system that locks and/or unlocks at least one access door 26 and/or 27 of locking insert mechanism 20. A second lock system is the dock lock mechanism 130 that locks and/or unlocks insert mechanism 20 to/from a mating receiver 50 when docking and/or separating the units. One or more of these lock mechanisms can be manually operated such as, but not limited to, a mechanical lock and key or security-type barrel lock and key. The lock mechanisms may also be electronically activated and electrically implemented utilizing a combination of electrical, mechanical, and/or electro-mechanical structure. The separate lock systems may have similar structure or dissimilar structures. For example, the access door lock system may be electronically controlled, with an electromechanical door lock mechanism and the dock lock system can comprise a completely manual lock structure) This does not preclude the use of pneumatic, hydraulic, magnetic, and/or wireless technologies and/or one or more combinations of various technologies. One or more of these lock systems can be accessed externally to the locking compartment of insert mechanism 20. One or more of these lock systems can be accessed and operated from inside the structure of insert mechanism 20 or, in the case of wireless data communication, such as various RFID and GPS technologies, part or all of the lock structures can be sealed within the structure of insert mechanism 20 and/or receiver 50 with no direct physical user access to lock control system 129 whether inside the locking compartment or external to the locking compartment of insert mechanism 20.

FIGS. 26*a*, 26*b*, 26*c*, 26*d*, 26*e*, 26*f*, 26*g*, 26*h*, 26*i*, and 26*j* are various views illustrating applications wherein the locking insert system disclosed herein may be utilized. It is to be noted that the number of applications in which the locking insert and receiver disclosed herein may be used far exceeds the examples described here and the locking insert and receiver may be used in other applications. For example, the locking insert system may be used with personal attire such as a vest, belt, boot or with different wearable carrying means such as leg straps, harnesses, bags and packs.

Figures 26A, 26B, 26C, 26D, 26E, 26F, 26G, 26H, 26I, 26J:
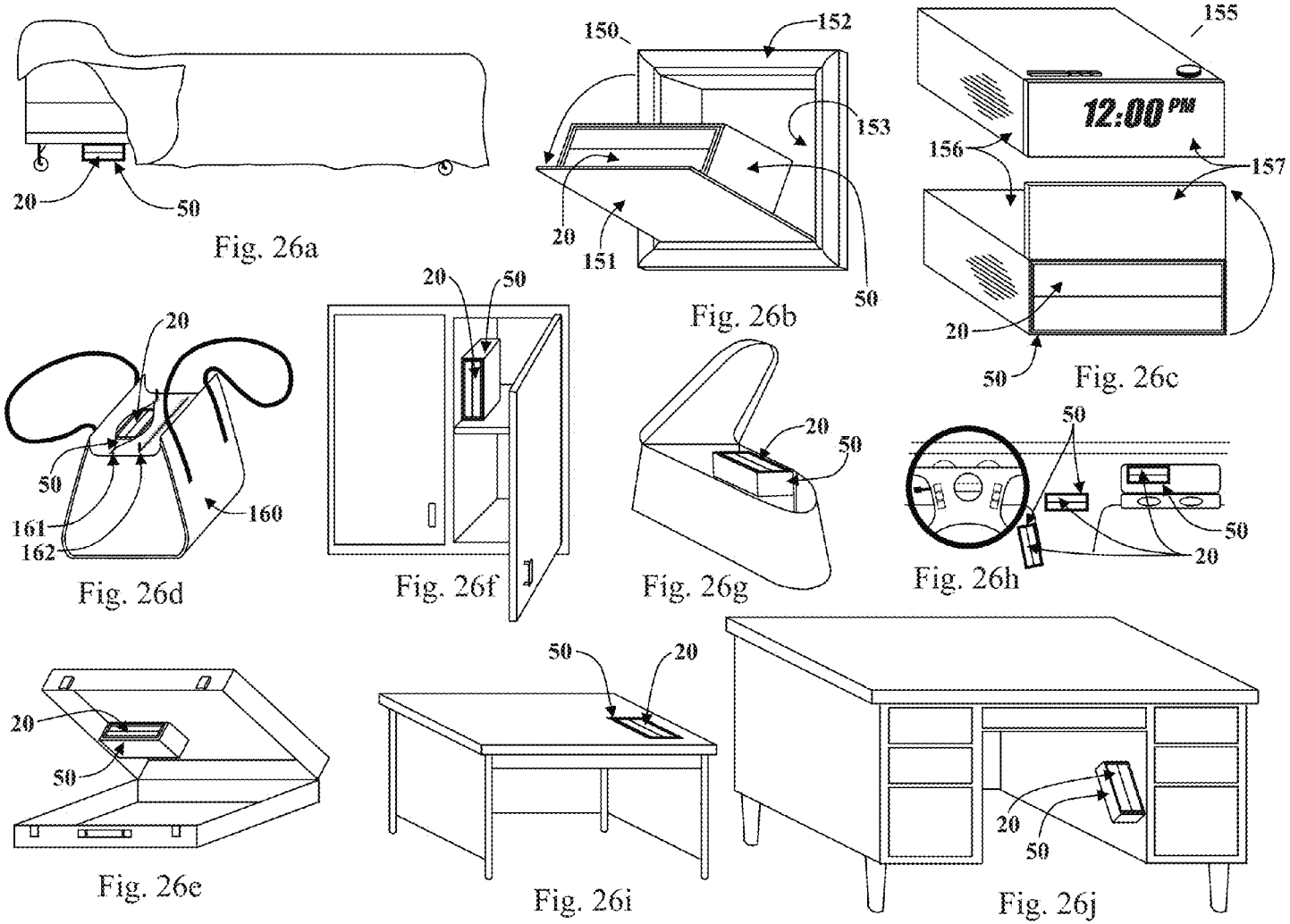
FIGS. 26*a*-26*j* are various views illustrating different applications wherein the locking insert system of the disclosure may be utilized.

FIG. 26*a* illustrates receiver 50 mounted to a bed frame. Locking insert mechanism 20 is inserted into and locked within receiver 50 allowing the authorized user(s) to have easy and quick access to the contents housed within locking insert mechanism 20 while in bed, in the bedroom, or in close proximity to the bedroom.

FIG. 26*b* illustrates an enclosure 150 having an access panel 151 that opens, allowing the authorized user(s) to have easy and quick access to the contents housed within locking insert mechanism 20. In one variation, enclosure 150 has a frame 151 that surrounds the outside edges of access panel 152. Enclosure 150 and frame 151 may be made to look like a picture frame or a mirror that is mounted onto a wall. The outside surface of frame 151 can be covered by, but not limited to, a photograph, painting, or a mirror. A hole 153 is cut in the wall or other surface to facilitate mounting enclosure 150 and frame 151 in a wall. Alternatively, enclosure 150 can also be mounted directly onto the wall or other surface without cutting a hole to facilitate recessing structure 153. Receiver 50 may be fastened to the back side of frame 151. Locking insert mechanism 20 may be inserted into and locked within receiver 50 allowing an authorized user to have easy and quick access to the contents housed within locking insert mechanism 20 while in close proximity to the area where receiver 50 is located.

FIG. 26*c* illustrates an enclosure 155 that resembles an alarm clock. Receiver 50 is fastened within the enclosure portion 156. Locking insert mechanism 20 is inserted into and locked within receiver 50. A faceplate 157 may be mounted onto enclosure portion 156 with a hinge, sliding, or detachable mechanism so positioned as to allow the faceplate to swing, pivot, slide, or be moved into a position that allows the authorized user(s) to have easy and quick access to the contents housed within locking insert mechanism 20. One embodiment of enclosure 155 includes a faceplate 157 that is a functioning clock.

FIG. 26*d* illustrates an embodiment described in connection with FIGS. 12*a-c*. Receiver 50 is mounted within handbag 160 with locking insert mechanism 20 inserted into and locked within receiver 50. Handbag 160 has at least one access opening. Accessible through zippers 161 and 162. First zipper 161 allows easy and quick access to locking insert mechanism 20 and the contents thereof by an authorized user. A second zipper 162 allows access to the internal body of the purse.

FIG. 26*e* illustrates a portable carrying case such as a brief case, computer case, equipment/instrument case, suit case, tool case, makeup bag, or other portable case, luggage, or bag. Receiver 50 is fastened to at least one inside surface of the bag or case. Insert mechanism 20 is inserted into and locked within receiver 50 allowing the authorized user(s) to have easy and quick access to the contents housed within locking insert mechanism 20 while in close proximity to the bag or case.

FIG. 26*f* illustrates a cabinet or similar enclosure such a kitchen cabinet, a medicine cabinet, a laundry room cabinet, a portion of a hutch, home entertainment cabinet, or other furniture, a work bench or tool cabinet. Receiver 50 is fastened to at least one surface of the cabinet. Insert mechanism 20 is inserted into and locked within receiver 50 allowing an authorized user to have easy and quick access to the contents housed within locking insert mechanism 20 while in close proximity to the enclosure.

FIG. 26*g* illustrates a console or compartment of a car, truck, boat, RV, airplane, or motorcycle. Receiver 50 is fastened within the console or compartment with, for example, angled mount 100 of FIG. 11. Locking insert mechanism 20 may be inserted into and locked within receiver 50 allowing an authorized user to have easy and quick access to the contents housed within locking insert mechanism 20 while in/on the vehicle or while in close proximity to the vehicle.

FIG. 26*h* illustrates a dashboard of a car, truck, boat, RV, or other motor vehicle where a receiver 50 may be mounted. Other potential applications include an instrument cluster of an airplane or jet aircraft or a tractor or riding lawn mower. As illustrated, receiver 50 may be fastened within the glove box. Alternatively, receiver 50 may be recessed and fastened into the dashboard or instrument cluster. Receiver 50 may also be mounted beneath the dashboard/instrument cluster or mounted onto the tunnel or door panel of the vehicle. Receiver 50 may also be mounted on the floor or ceiling of a vehicle, under a seat, on a door or wall panel, or affixed inside the trunk. Again, locking insert mechanism 20 is inserted into and locked within receiver 50 allowing the designated user(s) to have easy and quick access to the contents housed within locking insert mechanism 20 while in/on the vehicle or while in close proximity to the vehicle.

FIG. 26*i* illustrates a table such as a work bench, nightstand, security desk or other workstation. A mounting hole is cut into the surface of the tabletop (or other surface) of sufficient size to allow receiver 50 to be recessed into the hole and thereby mounted. Locking insert mechanism 20 is inserted into and locked within receiver 50. This application provides an authorized user easy and quick access to the contents housed within locking insert mechanism 20 while in close proximity to the table/desk/workstation/nightstand.

FIG. 26*j* illustrates a desk with receiver 50 mounted inside a drawer of the desk. Alternatively, receiver 50 may be mounted to an external wall of the desk under the desktop and within the chamber where the user's legs are normally positioned. Again, locking insert mechanism 20 is inserted into and locked within receiver 50 allowing the designated user(s) to have easy and quick access to the contents housed within locking insert mechanism 20 while sitting at the desk or while in close proximity to the desk.

The present invention allows a designated user to safely and securely carry valuable and personal items such as jewelry, personal heirlooms, money and/or precious metals, confidential documents, software media, prescription medication, handguns and/or other weapons with them virtually everywhere he or she goes throughout the day and night. Only the authorized user(s) has access to the contents within locking insert mechanism 20. Only the authorized user(s) can remove locking insert mechanism 20 from one docking location to a second, third, fourth, etc. docking location. Unauthorized persons such as teenagers, children, thieves, criminals, etc. are locked out of locking insert 20.

Figures 27A, 27B, 27C:
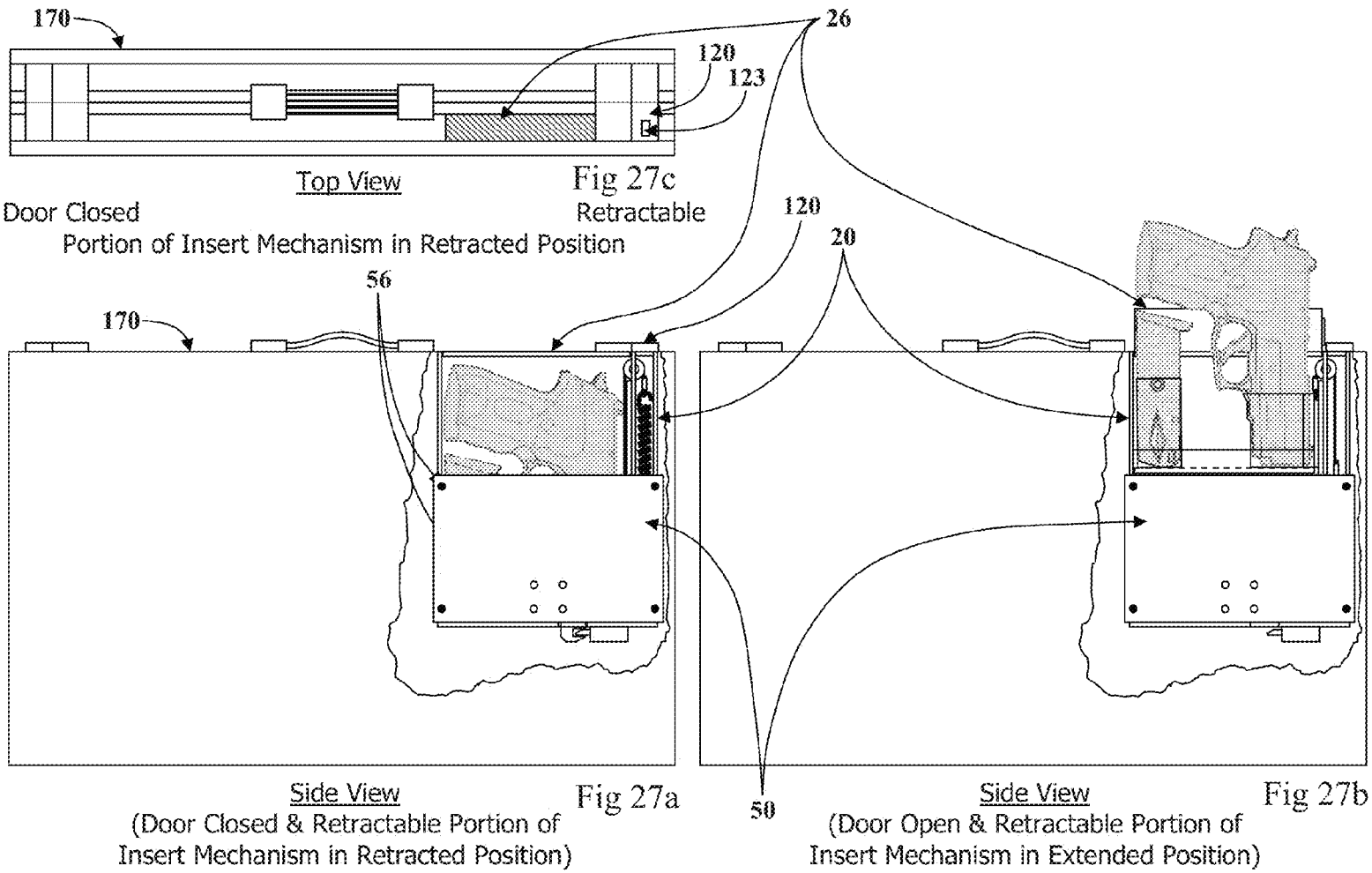
FIGS. 27*a*, 27*b*, and 27*c* are partial top and cut away side views of the insert mechanism of FIGS. 14*a* and 14*b* mounted in a case.

FIGS. 27*a*, 27*b*, and 27*c* are partial top and cut away side views of insert mechanism 20 of FIGS. 14*a* and 14*b* mounted in case 170. Case 170 may be an attaché case, a brief case, computer case, tool case, tool box, equipment case, or other luggage. An opening in one external wall of case 170, having sufficient length and width dimensions to allow insert mechanism 20 to pass through, is provided. Receiver 50 is mounted to at least one internal wall or panel of case 170 via rivets 93, screws 94, or other suitable fastener(s), and at least one hole 56 of receiver 50. Other structures may be used to mount receiver 50 to at least one internal surface of case 170. As illustrated, receiver 50 is mounted with access door 26 of insert mechanism 20 positioned flush to the respective external surface of case 170. An input device 120 of lock control system 129 is mounted so as to appear that it is part of the existing locking structure of case 170. Upon the correct activation of input device 120, control circuitry 124 causes door lock mechanism 70 to retract latch 71. Moving platform 86 (FIGS. 14*a*-14*b*) travels upward as access door 26 opens thereby providing user access to the contents housed within insert mechanism 20.

FIGS. 28*a*-28*f* are perspective views of a hand gun 198 illustrating a method to accommodate the use of locking insert mechanism 20 for items of various sizes and shapes, each item having unique dimensional parameters requiring a specific structure to house the item securely. Although the item presented in FIGS. 28*a*-28*f* for the purpose of describing the method is a handgun. The method is not limited to use with a handgun and may be used with a variety of other items.

Figure 28B:
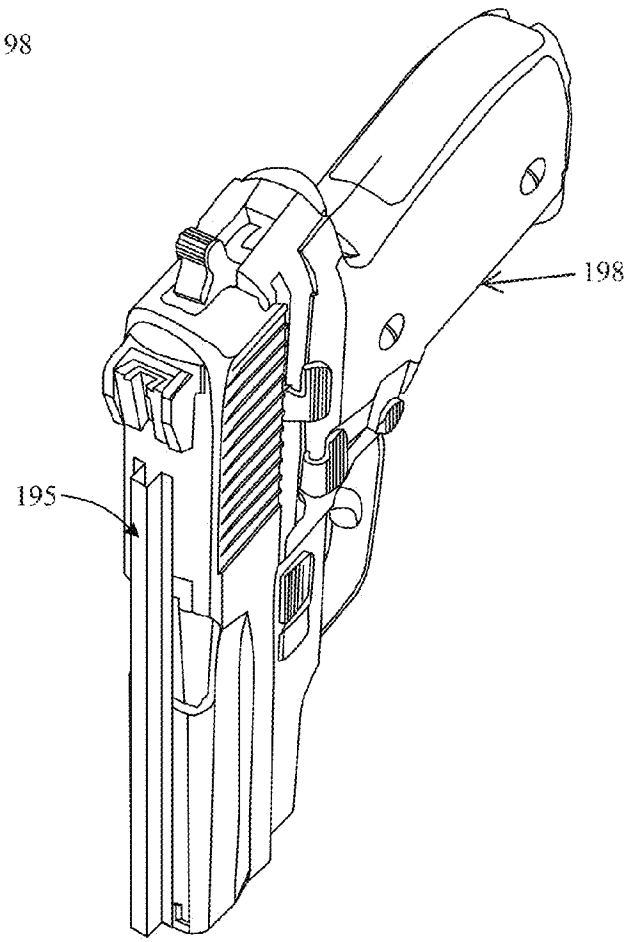
FIGS. 28*a*-28*f* are perspective views illustrating a method of utilizing the locking insert mechanism of the disclosure.
Figure 28A:
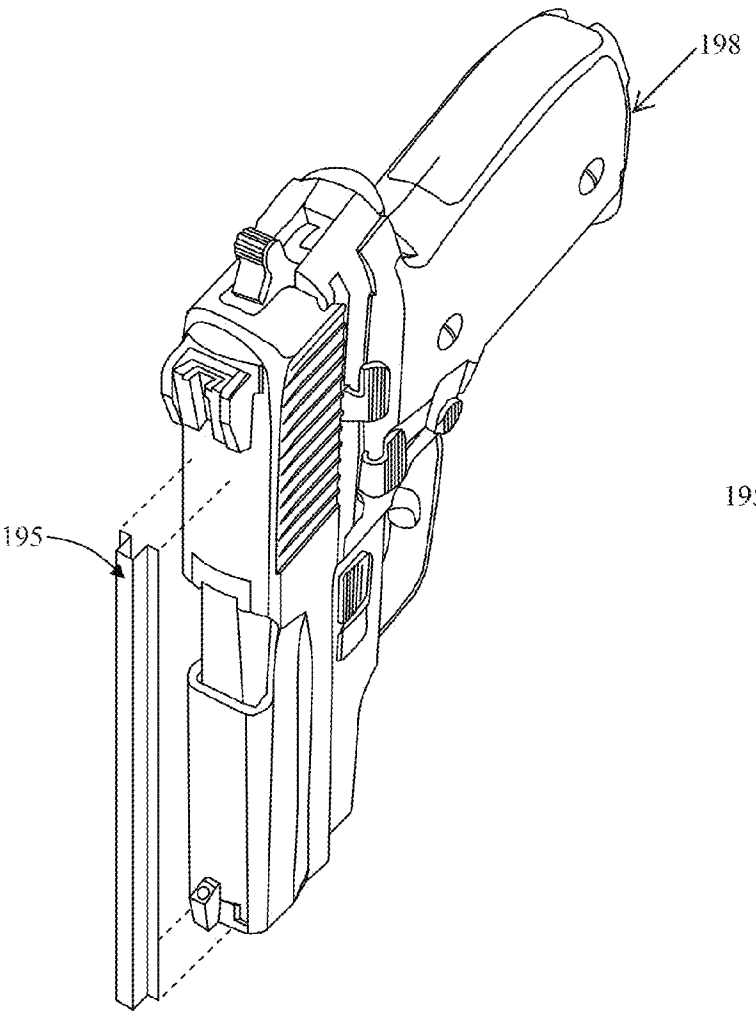
Figure 28D:
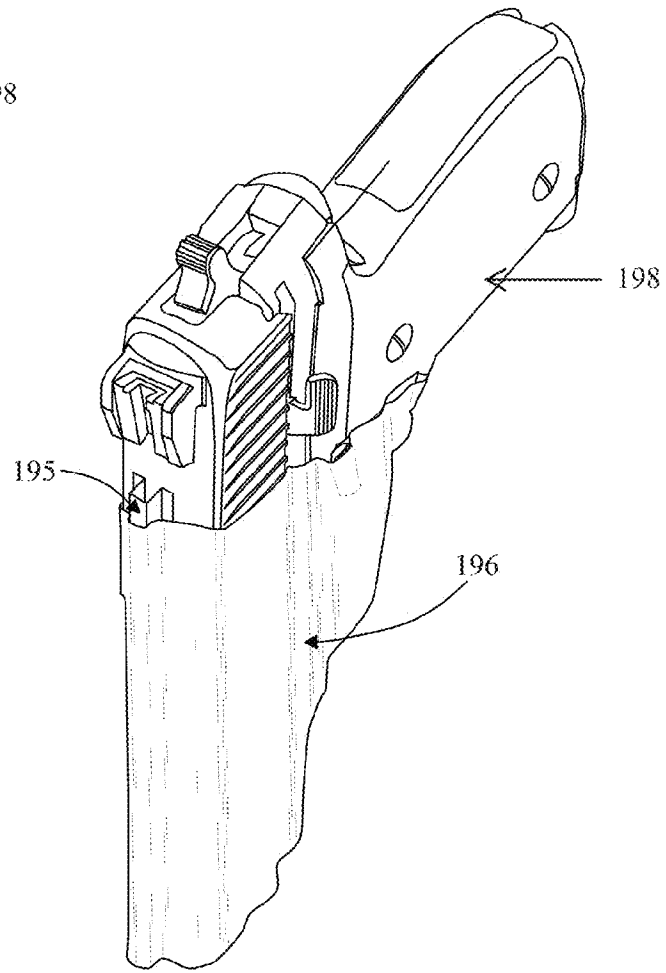
Figure 28C:
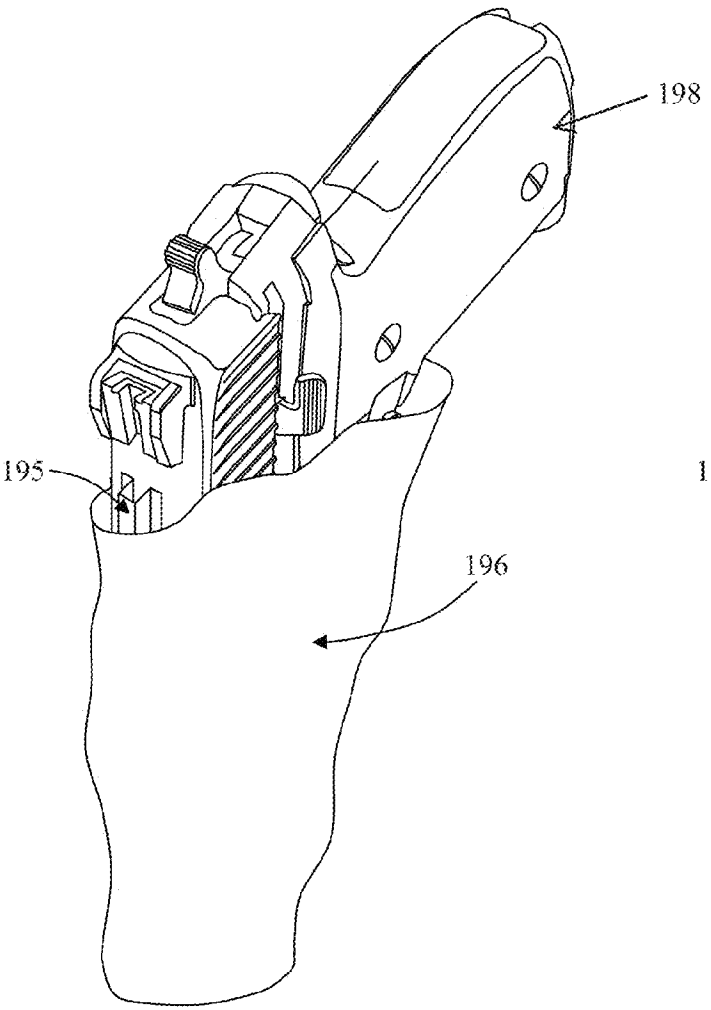
Figure 28F:
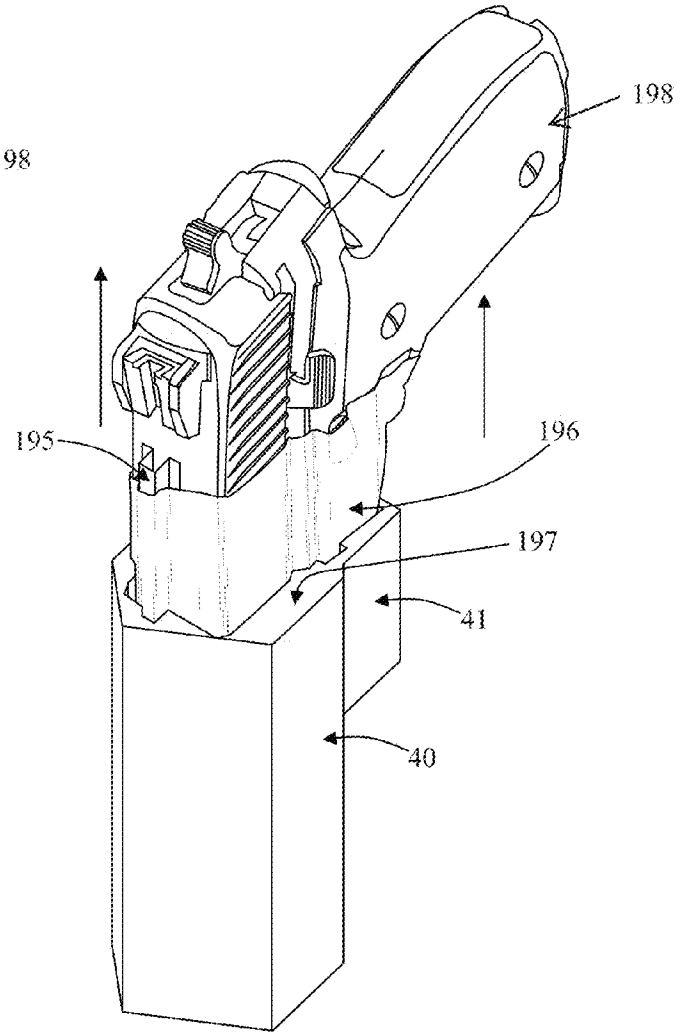
Figure 28E:
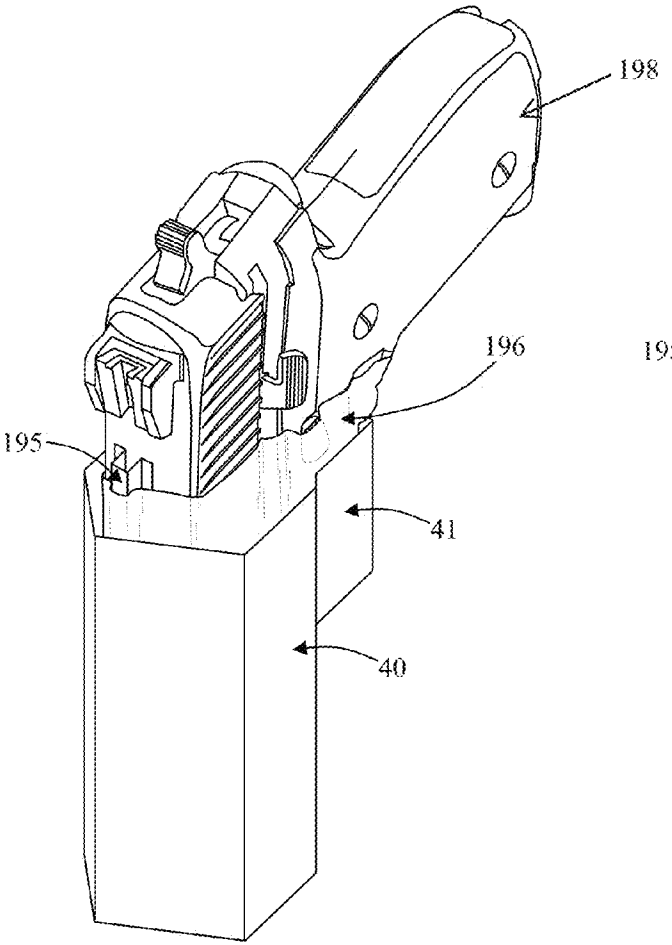

FIG. 28*a* illustrates a handgun 198 having top hat profile member 195. Top hat profile member 195 can be made of aluminum, plastic, or any other feasible material. Top hat profile member 195 is selected having an inside height that is slightly greater than the height of the front sight of the handgun 198 and having an inside width that is slightly greater than that of the front sight. Top hat profile member 195 is cut to a length that is slightly shorter that the distance between the front and rear sights of the handgun. A temporary, removable adhesive is applied to the two flanged surfaces of top hat profile member 195 on a side of each flange that is between of top hat profile member 195 and the top surface of handgun 195. The adhesive may be applied during manufacturing of top hat profile member 195 with a peel-off tape that is to be removed just prior to this initiating the process herein described. FIG. 28*b* shows handgun 198 after top hat profile member 195 has been adhered to the top portion of the handgun. The barrel and trigger guard portion of handgun 198, including top hat profile member 195, is place into heat shrink bag 196 as illustrated in FIG. 28*c* and heat is applied via a heat gun until heat shrink bag 196 has shrunk and tightly conforms to the outside structure of hand gun 198 as shown in FIG. 28*d*. A wax releasing agent such as Freeman's Wax Release is then applied to the external surfaces of heat shrink bag 196. A portion of casting resin 197 is poured into the encasement portion 40 and 41 of lower encasement 30 of locking insert mechanism 20 (FIG. 2*a*). FIG. 28*e* shows handgun 198 being properly placed into position within encasement portions 40 and 41. The remainder of casting resin 197 is poured around heat shrink bag 196. After casting resin 197 hardens handgun 198, heat shrink bag 196, and top hat profile member 195 are pulled vertically out of the casting as illustrated in FIG. 28*f*. Suitable casting resins 197 include Repro 83 Fast-Cast Urethane, Freeman 801 rigid Epoxy Casting Resin, or Freeman 1060 semi-rigid Urethane Elastomer.

It is to be noted that any combinations in structure and/or function disclosed in the Detailed Description of the Invention or of the disclosed embodiments are hereby included within the scope of the claimed invention. Although the disclosed embodiments have been described in detail, it should be understood that various changes, substitutions, and alterations can be made to the embodiments without departing from their spirit and scope. The benefits, advantages, solutions to problems, and any element(s) that may cause any benefit, advantage, or solution to occur or become more pronounced are not to be construed as a critical, required, or essential feature or element of the claimed invention. The claimed invention is not intended to be limited to the specific form set forth herein, but to the contrary, it is intended to cover such alternatives, modifications, and equivalents, as can be reasonably included within the spirit and scope of the invention as provided by the claims below.

What is claimed is:

1. A portable security apparatus comprising:

a first structure having a compartment comprising a plurality of walls and at least one access port, the access port providing access to insert and remove one or more items from the first structure;

a first accessible lock device controllable to lock and/or to unlock the at least one access port;

a second structure configured to receive the first structure, the second structure comprising a first mounting structure to couple the first structure to the second structure such that the at least one access port is accessible when the first and second structures are coupled and a second mounting structure to attach the second structure to one or more external structures;

a second lock device to lock the first structure to the second structure; and a door covering the at least one access port wherein the door is coupled to the first structure with a hinge.

2. The portable security apparatus of claim 1, wherein a portion of the first structure is made from at least one metal alloy including but not limited to aluminum, steel, chromium, iron, cobalt, copper, brass, bronze, magnesium, tin, zinc, nickel, gold, silver, and titanium.

3. The portable security apparatus of claim 1, wherein a portion of the first structure is made from at least one polymer including but not limited to structural plastic, polyethylene, polypropylene, reinforced thermo plastic, bakelite, kevlar, twaron, teflon, zylon, acrylic, glass filled nylon, fiberglass, abs, structural foam, and carbon fiber.

4. The portable security apparatus of claim 1, wherein a portion of the second structure is made from at least one metal alloy including but not limited to aluminum, steel, chromium, iron, cobalt, copper, brass, bronze, magnesium, tin, zinc, nickel, gold, silver, and titanium.

5. The portable security apparatus of claim 1, wherein a portion of the second structure is made from at least one polymer including but not limited to structural plastic, polyethylene, polypropylene, reinforced thermo plastic, bakelite, kevlar, twaron, teflon, zylon, acrylic, glass filled nylon, fiberglass, abs, structural foam, and carbon fiber.

6. The portable security apparatus of claim 1, wherein the compartment of the first structure further comprises an upper encasement section and a lower encasement section mountable to the upper encasement section.

7. The portable security apparatus of claim 1, wherein the first lock device has a mechanical locking device including one or a combination of a key lock, a barrel security key lock and a combination lock.

8. The portable security apparatus of claim 1, further comprises control circuitry.

9. The portable security apparatus of claim 1, wherein the first lock device further comprises a radio frequency identification device (RFID).

10. The portable security apparatus of claim 1, wherein the first lock device further comprises at least one biometric detection device.

11. The portable security apparatus of claim 1, wherein the first lock device includes at least one of a mechanical locking device, radio frequency identification device (RFID), and biometric detection device.

12. The portable security apparatus of claim 6, wherein one of the upper encasement section or the lower encasement section further comprises an angled surface.

13. The portable security apparatus of claim 8, wherein the first lock device is coupled to control circuitry.

14. A portable security apparatus comprising:

a first structure having a compartment comprising at least one wall and at least one access door, the access door providing access to insert and remove one or more items from the first structure;

a first coupling device for coupling and decoupling a portion of the access door panel to and from the first structure;

at least one second structure configured to receive the first structure, the second structure further comprising a first mounting structure to couple the first structure to the second structure;

a second coupling device to couple/decouple the first structure to the second structure such that the access door is accessible when the first and second structures are coupled such that the one or more items are accessible via the access door.

15. The portable security apparatus of claim 14 further comprising a lock device controllable to lock and/or to unlock the access door.

16. The portable security apparatus of claim 15 wherein the lock device includes at least one of a mechanical locking device, an electromechanical locking device, a radio frequency identification device (RFID), and a biometric detection device.

17. The portable security apparatus of claim 14, further comprising control circuitry configured to control the coupling and/or decoupling of a portion of the access door panel to/from the first structure and/or configured to control the coupling and/or decoupling of the first structure to/from the second structure.

18. The portable security device of claim 14 further comprising a second lock device, the second lock device locking the first structure to the second structure.

* * * * *